US008642517B2

(12) United States Patent
Matsui et al.

(10) Patent No.: US 8,642,517 B2
(45) Date of Patent: Feb. 4, 2014

(54) LUBRICANT OIL COMPOSITION

(75) Inventors: Shigeki Matsui, Yokohama (JP); Akira Yaguchi, Yokohama (JP)

(73) Assignee: Nippon Oil Corporation, Tokyo (JP)

( * ) Notice: Subject to any disclaimer, the term of this patent is extended or adjusted under 35 U.S.C. 154(b) by 127 days.

(21) Appl. No.: 12/745,917

(22) PCT Filed: Dec. 3, 2008

(86) PCT No.: PCT/JP2008/071968

§ 371 (c)(1),
(2), (4) Date: Jul. 8, 2010

(87) PCT Pub. No.: WO2009/072524

PCT Pub. Date: Jun. 11, 2009

(65) Prior Publication Data

US 2011/0003725 A1 Jan. 6, 2011

(30) Foreign Application Priority Data

Dec. 5, 2007 (JP) ..... P2007-315061
Dec. 28, 2007 (JP) ..... P2007-340431
Jan. 15, 2008 (JP) ..... P2008-006038

(51) Int. Cl.
*C10M 169/04* (2006.01)
*C10G 71/00* (2006.01)

(52) U.S. Cl.
USPC ..... 508/110; 208/18

(58) Field of Classification Search
USPC ..... 508/110, 118, 463; 208/18
See application file for complete search history.

(56) References Cited

U.S. PATENT DOCUMENTS 2,861,941 A * 11/1958 Jancosek et al. ..... 208/25
2,890,161 A 6/1959 Brown et al.
3,078,222 A 2/1963 Henke et al.
3,847,790 A 11/1974 Putz
4,606,834 A * 8/1986 Hart et al. ..... 508/471
5,282,958 A 2/1994 Santilli et al.
5,520,832 A * 5/1996 Alexander ..... 508/469
6,059,955 A 5/2000 Cody et al.
6,090,989 A * 7/2000 Trewella et al. ..... 585/13
6,103,099 A 8/2000 Wittenbrink et al.
6,179,994 B1 1/2001 Clark et al.
6,420,618 B1 7/2002 Berlowitz et al.
6,602,402 B1 8/2003 Benazzi et al.
7,285,206 B2 10/2007 Germaine
7,641,786 B2 1/2010 Wang et al.
7,642,095 B2 1/2010 Wang et al.
7,914,665 B2 3/2011 Zhang et al.
2002/0119896 A1 8/2002 Yagishita et al.
2004/0045868 A1 3/2004 Germaine
2004/0065588 A1 4/2004 Genetti et al.
2004/0074810 A1 4/2004 Hoek et al.
2004/0077505 A1 4/2004 Daniel et al.
2004/0077509 A1 4/2004 Yuki et al.
2004/0079675 A1 4/2004 Germaine et al.
2004/0092409 A1 5/2004 Liesen
2004/0099571 A1 5/2004 Germaine et al.
2004/0108248 A1 6/2004 Cody et al.
2004/0108249 A1 6/2004 Cody et al.
2004/0118744 A1 6/2004 Daniel et al.
2004/0119046 A1 6/2004 Carey et al.
2004/0129603 A1 7/2004 Fyfe et al.
2004/0154957 A1 8/2004 Keeney et al.
2004/0154958 A1 8/2004 Alexander et al.
2005/0261147 A1* 11/2005 Rosenbaum et al. ..... 508/466

(Continued)

FOREIGN PATENT DOCUMENTS

CN 1500133 5/2004
CN 101065469 10/2007

(Continued)

OTHER PUBLICATIONS

International Preliminary Examination Report (in English) from PCT/JP2008/071968, mailed Aug. 19, 2010.

(Continued)

*Primary Examiner* — Prem C Singh
*Assistant Examiner* — Francis C Campanell
(74) *Attorney, Agent, or Firm* — Greenblum & Bernstein, P.L.C.

(57) ABSTRACT

The present invention provides a lubricating oil composition comprising:

a lubricating base oil including a lubricating base oil component having a urea adduct value of 4% by mass or less, a kinematic viscosity of 25 $mm^2/s$ or less at 40° C. and a viscosity index of 120 or greater, wherein the amount of the lubricating base oil component is 10 to 100% by mass based on a total mass of the lubricating base oil, and a poly(meth)acrylate based viscosity index improver including a structural unit represented by general formula (1):

[Chemical Formula 1]

(1)

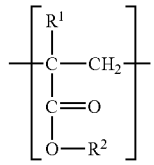

wherein $R^1$ represents hydrogen or a methyl group, and $R^2$ represents a straight or branched hydrocarbon group with 16 or more carbon atoms, and wherein the proportion of the structural unit represented by general formula (1) is 0.5 to 70% by mole, the lubricating oil composition having a kinematic viscosity of 4 to 12 $mm^2/s$ at 100° C. and a viscosity index of 140 to 300.

11 Claims, No Drawings

(56) References Cited

U.S. PATENT DOCUMENTS

| | | | |
|---|---|---|---|
| 2006/0205610 | A1 | 9/2006 | Rosenbaum et al. |
| 2007/0138052 | A1 | 6/2007 | Kobayashi et al. |
| 2007/0191239 | A1 | 8/2007 | Matsuoka et al. |
| 2008/0116108 | A1 | 5/2008 | Zhang et al. |
| 2008/0163672 | A1 | 7/2008 | Wang et al. |
| 2008/0206878 | A1 | 8/2008 | Wang et al. |
| 2010/0041572 | A1 | 2/2010 | Sano et al. |
| 2010/0130395 | A1 | 5/2010 | Tagawa et al. |
| 2010/0137176 | A1 | 6/2010 | Aoki et al. |
| 2010/0190671 | A1 | 7/2010 | Stoehr et al. |
| 2011/0003725 | A1 | 1/2011 | Matsui et al. |
| 2011/0049008 | A1 | 3/2011 | Tagawa et al. |
| 2011/0049009 | A1 | 3/2011 | Tagawa et al. |
| 2012/0065109 | A1 | 3/2012 | Matsuoka et al. |

FOREIGN PATENT DOCUMENTS

| | | |
|---|---|---|
| EP | 0021634 | 1/1981 |
| EP | 1749876 | 2/2007 |
| EP | 1845151 | 10/2007 |
| EP | 1997871 | 12/2008 |
| EP | 2135929 | 12/2009 |
| EP | 2241611 | 10/2010 |
| JP | 30-000624 | 2/1955 |
| JP | 31-003928 | 5/1956 |
| JP | 45-019183 | 7/1970 |
| JP | S48-025003 | 4/1973 |
| JP | 56-002398 | 1/1981 |
| JP | 4-036391 | 2/1992 |
| JP | 4-068082 | 3/1992 |
| JP | 4-120193 | 4/1992 |
| JP | 5-508876 | 12/1993 |
| JP | 06-306384 | 11/1994 |
| JP | 08-302378 | 11/1996 |
| JP | 2000-345170 | 12/2000 |
| JP | 2000-345171 | 12/2000 |
| JP | 2001-181664 | 7/2001 |
| JP | 2001-279287 | 10/2001 |
| JP | 2001-520302 | 10/2001 |
| JP | 2002-503752 | 2/2002 |
| JP | 2002-503754 | 2/2002 |
| JP | 2002-105477 | 4/2002 |
| JP | 2002-129182 | 5/2002 |
| JP | 2003-292938 | 10/2003 |
| JP | 2004-124080 | 4/2004 |
| JP | 2004-169029 | 6/2004 |
| JP | 2004-521976 | 7/2004 |
| JP | 2004-521977 | 7/2004 |
| JP | 2004-522848 | 7/2004 |
| JP | 2004-526831 | 9/2004 |
| JP | 2004-528426 | 9/2004 |
| JP | 2004-536894 | 12/2004 |
| JP | 2005-154760 | 6/2005 |
| JP | 2005-187736 | 7/2005 |
| JP | 2005-239840 | 9/2005 |
| JP | 2006-502289 | 1/2006 |
| JP | 2006-502297 | 1/2006 |
| JP | 2006-502298 | 1/2006 |
| JP | 2006-502303 | 1/2006 |
| JP | 2006-509899 | 3/2006 |
| JP | 2006-117851 | 5/2006 |
| JP | 2006-518395 | 8/2006 |
| JP | 2006-241436 | 9/2006 |
| JP | 2006-521416 | 9/2006 |
| JP | 2007-002009 | 1/2007 |
| JP | 2007-045850 | 2/2007 |
| JP | 2007-137952 | 6/2007 |
| JP | 2007-186638 | 7/2007 |
| JP | 2007-217494 | 8/2007 |
| JP | 2007-246661 | 9/2007 |
| JP | 2007-254559 | 10/2007 |
| JP | 2007-269885 | 10/2007 |
| JP | 2007-270059 | 10/2007 |
| JP | 2007-270062 | 10/2007 |
| JP | 2008-520770 | 6/2008 |
| JP | 2010-532805 | 10/2010 |
| WO | 2004/053030 | 6/2004 |
| WO | 2005/090528 | 9/2005 |
| WO | 2005/0950528 | 9/2005 |
| WO | 2006/055901 | 5/2006 |
| WO | 2007/114132 | 10/2007 |
| WO | 2007/114260 | 10/2007 |
| WO | 2010/010807 | 1/2010 |
| WO | 2010/041689 | 4/2010 |
| WO | 2010/041692 | 4/2010 |

OTHER PUBLICATIONS

Search report from E.P.O. that issued patent family member European Patent Application No. 08856395.2 on May 26, 2011, mail date is May 26, 2011.

International Preliminary Report on Patentability (in English), including the Written Opinion, for PCT/JP2008/055574, mailed Oct. 22, 2010.

International Search Report that issued in connection with PCT/JP2008/055574, mailed Jun. 24, 2008.

English language Abstract of WO 2004/033596, corresponding to JP 2006-502289, Jan. 19, 2006.

English language Abstract of WO 2004/033597, corresponding to JP 2006-502297, Jan. 19, 2006.

English language Abstract of WO 2004/065588, corresponding to JP 2006-502298, Jan. 19, 2006.

English language Abstract of WO 2004/033606, corresponding to JP 2006-502303, Jan. 19, 2006.

English language Abstract of WO 99/41334, corresponding to JP 2002-503754 , Feb. 5, 2002.

English language Abstract of US 2004/154957, corresponding to JP 2006-509899, Mar. 23, 2006.

English language Abstract of WO 2004/053034, corresponding to JP 2006-518395, Aug. 10, 2006.

English language Abstract of WO 2004/053030, corresponding to JP 2006-521416, Sep. 21, 2006.

English language Abstract of WO 02/064710, corresponding to JP 2004-521976, Jul. 22, 2004.

English language Abstract of US 2004/045868, corresponding to JP 2004-522848, Jul. 29, 2004.

English language Abstract of US 2004/045868, corresponding to JP 2004-526831, Sep. 2, 2004.

English language Abstract of US 2004/074810, corresponding to JP 2004-536894, Dec. 9, 2004.

English language Abstract of WO 02/064710, corresponding to JP 2004-521977, Jul. 22, 2004.

Office Action issued with respect to patent family member U.S. Appl. No. 12/593,400 on Sep. 30, 2011.

Lilianna Z Pillon, "Use of NMR Spectroscopy to Study the Effect of Hydrocraking on the Chemistry of Hydrocarbons", Petroleum Science and Technology, Marcel Dekker, New York, NY, US, vol. 20, No. 3&4, XP009148193 , Jan. 1, 2002, pp. 357-365.

Veretennikova T N et al., "Mechanism of action of pour-point depressants in diesel fuels ", Chemistry and Technology of Fuels and Oils, Consultants Bureau, US, vol. 16, No. 6, XP007918564, Jan. 1, 1980, pp. 392-395.

Krishna R et al., "Correlation of pour point of gas oil and vacuum gas oil fractions with compositional parameters", Energy & Fuels, American Chemical Society, Washington, DC, US, vol. 3, No. 1, XP007918565, Jan. 1, 1989, pp. 15-20.

Turner C H et al., "Estimation of chain branching in paraffin waxes using proton magnetic resonance spectroscopy and gas-liquid chromatography", Journal of Chromatography, Elsevier Science Publishers B. V. NL, vol. 287, XP026476547, Jan. 1, 1984, pp. 305-312.

Sharma et al., "Predicting Low Temperature Lubricant Rheology Using Nuclear Magnetic Resonance Spectroscopy and Mass Spectrometry", Tribology Letters, Kluwer Academic Publishers-Plenum Publishers, NE, vol. 16, No. 1-2, XP007918586, Feb. 1, 2004, pp. 11-19.

Search report from E.P.O. that issued with respect to patent family member European Patent Application No. 08722784.9, mail date is May 27, 2011.

(56) References Cited

OTHER PUBLICATIONS

Chinese Office action issued with respect to Chinese Patent Application No. 200880010885.6, mailed Apr. 23, 2012.
Office Action issued with respect to patent family member Chinese Patent Application No. 200880119102.8, mailed Jul. 31, 2012.
Notification of Information Provision issued with respect to Japanese Patent Application No. 2008-309013, mailed Oct. 2, 2012.
Search Report issued with respect to patent family member European Patent Application No. 12003139.8, mailed Jul. 10, 2012.
Office Action issued with respect to patent-family member Japanese Patent Application No. 2008-006038, mailed Dec. 4, 2012.
Search Report from E.P.O. issued with respect to patent family member European Patent Application No. 11010052.6, mailed Jun. 12, 2012.
Office Action issued in relation to U.S. Appl. No. 12/593,400, mailed Jun. 21, 2012.
Notification of Information Provision issued in Japanese Patent Application No. 2009-509113, mailed Jun. 26, 2012.
Shinya Sato et al., "Separation of n-Paraffin and 1-Olefin in Shale Oil by Urea Adduct Method", Sekiyu Gakkaishi, vol. 39, No. 5, 1996, pp. 365-368 with partial English-language translation.
Notification of Information Provision issued with respect to patent family member Japanese Patent Application No. 2007-340431, mailed Jan. 8, 2013.
Notification of Information Provision issued with respect to patent family member Japanese Patent Application No. 2007-340431, mailed Feb. 12, 2013.
Tanaka, "Lecture, Fundamentals of Lubricant Additives (3), Viscosity Index Improver", The Tribologist, vol. 52, No. 11, pp. 789-792 (Jun. 6, 2007), with partial English-language translation thereof.
Yamada, "Grade of Engine Oils", Society of Automotive Engineers of Japan, vol. 53, No. 4, pp. 86-88 (Feb. 12, 1999), with partial English-language translation thereof.
Notice of Information Provision in JP Patent Application No. P2007-340431, mailed on Jul. 23, 2013.
Notification of Information Provision for Japanese Appl. No. 2008-006038, dated Sep. 3, 2013.
Office action for JP Application No. 2009-509113, mailed May 14, 2013.
Notification of Information Provision for JP Patent Application No. P2008-006038, mailed May 15, 2013.
Hiroshi Ohtsuka et al., "separation of straight-chain hydrocarbons from petroleum fractions by means of urea adduct formation", Bulletin of the Faculty of Engineering, Hokkaido University, 40, Mar. 30, 1966 p. 125-137; and a partial English translation thereof.
Yozo Oshima et al., "Monomethylparraffins in n-Paraffins Adducted from Petroleum Fractions", Sekiyu Gakkaishi, vol. 18, No. 6, 1975, p. 497-502.
"Glossary of Lubrication Terminology-with definitions-" Japanese Society of Lubrication, vol. 3, No. 1, Jul. 20, 1981; and partial English translation thereof.
V.J. Gatto et al., "The Influence of Chemical Structure on the Physical Properties and Antioxidant Response of Hydrocracked Base Stocks and Polyalphaolefins" J. Synthetic Lubrication 19-1, Apr. 2002, p. 3-18.
Helen T. Ryan, "Use of Group II and Group III base stocks in hydraulic and industrial applications" Industrial Lubrication and Tribology 51, 1999, p. 287-293.
Jinichi Igarashi, "Current Situation and Future Trends in Lubricant Base Oils" The Tribologist, vol. 48 No. 4, 2003, p. 265-271; and English partial translation thereof.
Office Action for JP Patent Application No. P2008-006038, mailed on Oct. 22, 2013.

* cited by examiner

LUBRICANT OIL COMPOSITION

TECHNICAL FIELD

The present invention relates to a lubricating oil composition.

BACKGROUND ART

Conventionally, lubricating oils are used for smoothing the operation of internal combustion engines, transmissions and other mechanical devices. In particular, lubricating oils for internal combustion engines (engine oils) are required to be high-performance as the internal combustion engines are designed to provide higher performances and higher powers, and be operated under increasingly severe conditions. Accordingly, in order to meet such performances required, various additives such as anti-wear agents, metallic detergents, ashless dispersants and antioxidants are used for conventional engine oils (see, for example, Patent documents 1 to 3). Recently, as the fuel saving performance required for lubricating oil is getting higher, considerations have been given to applications of high viscosity index base oil and various friction modifiers (see, for example, Patent document 4).

[Patent document 1] Japanese Unexamined Patent Publication No. 2001-279287

[Patent document 2] Japanese Unexamined Patent Publication No. 2002-129182

[Patent document 3] Japanese Unexamined Patent Publication HEI No. 08-302378

[Patent document 4] Japanese Unexamined Patent Publication HEI No. 06-306384

DISCLOSURE OF THE INVENTION

Problems to be Solved by the Invention

Conventional lubricating oils, however, are not necessarily adequate in terms of fuel savings and low temperature viscosity characteristics.

As a common fuel saving techniques, lowering of kinematic viscosity of a product, and improvement of viscosity index that is synonymous with multi-grading by combining lowering of base oil viscosity and addition of a viscosity index improver are known. However, lowering of viscosity of product or base oil deteriorate lubrication performance thereof under a severe lubrication condition (high-temperature and high-shear condition) and raise concerns to cause problems such as wear, seizure and fatigue failure.

Therefore, in order to prevent such problems from occurring and maintain durability, it is necessary to maintain high-temperature high-shear (HTHS) viscosity at 150° C. More specifically, in order to further provide fuel savings while maintaining other practical performances, it is important to lower kinematic viscosity at 40° C., kinematic viscosity at 100° C. and HTHS viscosity at 100° C. and to raise the viscosity index, while maintaining the HTHS viscosity at 150° C. to a constant level.

In view of the problems described above, an object of the present invention is to provide lubricating oil compositions that are superior in fuel savings and lubricity.

Means for Solving the Problem

A first aspect of the present invention provides a lubricating oil composition (hereinafter referred to as a "first lubricating oil composition") comprising:

a lubricating base oil including a lubricating base oil component having a urea adduct value of 4% by mass or less, a kinematic viscosity of 25 $mm^2/s$ or less at 40° C. and a viscosity index of 120 or greater, wherein the amount of the lubricating base oil component is 10 to 100% by mass based on a total mass of the lubricating base oil, and a poly(meth)acrylate based viscosity index improver including a structural unit represented by general formula (1):

[Chemical Formula 1]

(1)

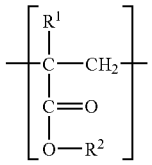

wherein $R^1$ represents hydrogen or a methyl group, and $R^2$ represents a straight or branched hydrocarbon group with 16 or more carbon atoms, and wherein the proportion of the structural unit represented by general formula (1) is 0.5 to 70% by mole, the lubricating oil composition having a kinematic viscosity of 4 to 12 $mm^2/s$ at 100° C. and a viscosity index of 140 to 300.

Here, the term "urea adduct value" means the value measured by the following method. Weighted sample oil (lubricating base oil) of 100 g placed in a round flask is added with 200 mg of urea, 360 ml of toluene and 40 ml of methanol, and is stirred at room temperature for 6 hours. Consequently, in the reaction solution, white granular crystals are produced as urea adducts. By filtering the reaction solution through a 1-micron filter, the white granular crystals produced are collected, and the obtained crystals are rinsed six times with 50 ml of toluene. The retrieved white crystals are placed in a flask with additional 300 ml of deionized water and 300 ml of toluene, and are stirred at 80° C. for 1 hour. Aqueous phase is separated and removed with a separating funnel, and toluene phase is rinsed three times with 300 ml of deionized water. After dewatering process by adding desiccant (sodium sulfate) to the toluene phase, toluene is distilled away. The proportion (mass percentage) of the urea adducts thus obtained with respect to the sample oil is defined as the urea adduct value.

In the measurement of the urea adduct value described above, the fact that components out of isoparaffin that adversely affect low temperature viscosity characteristics or that deteriorate heat conductivity and, further, normal paraffin in the case where the normal paraffin remains in the lubricating base oil can be collected as urea adducts with good accuracy and without fail makes the measurement excellent as an evaluation index for low temperature viscosity characteristics and heat conductivity of the lubricating base oil. The inventors of the present invention have confirmed that, by analyses using GC and NMR, the n ain components of the urea adducts are the urea adducts of normal paraffin and of isoparaffin with 6 or more carbon atoms between an end of the main chain and a branch point.

The term "poly(meth)acrylate" herein is a collective term for polyacrylate and polymethacrylate.

In the first lubricating oil composition, it is preferable that the poly(meth)acrylate based viscosity index improver is a dispersant poly(meth)acrylate based viscosity index improver.

In the first lubricating oil composition, it is preferable that the poly(meth)acrylate based viscosity index improver has a PSSI of 40 or less and a ratio of weight average molecular weight and PSSI of $1\times10^4$ or greater.

The term "PSSI" here means a permanent shear stability index of a polymer that complies with ASTM D 6022-01 (Standard Practice for Calculation of Permanent Shear Stability Index) and is calculated based on the data measured complying with ASTM D 6278-02 (Test Method for Shear Stability of Polymer Containing Fluids Using a European Diesel Injector Apparatus).

It is preferable that, as for the poly(meth)acrylate based viscosity index improver, $R^2$ in general formula (1) is a branched hydrocarbon group with 20 or more carbon atoms.

It is preferable that the first lubricating oil composition further comprises at least one friction modifier selected from organic molybdenum compounds and ashless friction modifiers.

A second aspect of the present invention provides a lubricating oil composition (hereinafter referred to as a "second lubricating oil composition") comprising:

a lubricating base oil having a kinematic viscosity of 1 to 10 $mm^2/s$ at 100° C. and a % $C_A$ of 5 or less, and a viscosity index improver having a weight average molecular weight of 50,000 or greater and a ratio of the weight average molecular weight and PSSI of $0.8\times10^4$ or greater, wherein the amount of the viscosity index improver is 0.1 to 50% by mass based on a total mass of the lubricating oil composition, the lubricating oil composition having a kinematic viscosity of 3 to 9.3 $mm^2/s$ at 100° C. and a ratio of HTHS viscosity at 150° C. and HTHS viscosity at 100° C. at 0.50 or greater.

The HTHS viscosity at 100° C. or at 150° C. herein indicates the high-temperature high-shear viscosity at 100° C. or at 150° C., respectively, defined in ASTM D4683. It is preferable that the second lubricating oil composition has an HTHS viscosity of 2.6 mPa·s or greater at 150° C. and an HTHS viscosity of 5.3 mPa·s or less at 100° C.

A third aspect of the present invention provides a lubricating oil composition (hereinafter referred to as a "third lubricating oil composition") comprising:

a lubricating base oil including as a main component, a lubricating base oil component having a saturated component content of 95% by mass or greater, a proportion of cyclic saturated component of 60% by mass or less contained in the saturated component content, a viscosity index of 120 or greater, and ϵ-methylene content in total constituent carbons at a proportion of 15 to 20%, and a viscosity index improver having a weight average molecular weight of 50,000 or more and a ratio of the weight average molecular weight and PSSI at $1\times10^4$ or more, in an amount of 0.1 to 50% by mass based on a total mass of the lubricating oil composition, the lubricating oil composition having a kinematic viscosity of 3.0 to 12.0 $mm^2/s$ at 100° C. and a ratio of HTHS viscosity at 150° C. and HTHS viscosity at 100° C. at 0.50 or more.

It is preferable that the third lubricating oil composition has an HTHS viscosity of 2.6 mPa·s or greater at 150° C. and an HTHS viscosity of 5.3 mPa·s or less at 100° C.

It is preferable that the viscosity index improver in the third lubricating oil composition is a dispersant poly(meth)acrylate based viscosity index improver.

It is preferable that the third lubricating oil composition further comprises at least one friction modifier selected from organic molybdenum compounds and ashless friction modifiers.

Effects of the Invention

According to the first, second and third lubricating oil compositions, fuel savings and lubricity can be both achieved at high levels.

More specifically, the first lubricating oil composition has excellent fuel savings and low temperature viscosity characteristics. While maintaining the HTHS viscosity at 150° C. without using a synthetic oil such as poly-α-olefin based base oil and ester based base oil, or a low viscosity mineral base oil, both requirements of the fuel savings and low temperature viscosity at −35° C. or lower can be achieved and, in particular, the kinematic viscosities of lubricating oil at 40° C. and at 100° C. and the HTHS viscosity thereof at 100° C. can be reduced and a CCS viscosity at −35° C. can be significantly improved.

The second lubricating oil composition has excellent fuel savings and lubricity. While maintaining the HTHS viscosity at a constant level without using a synthetic oil such as poly-α-olefin based base oil and ester based base oil, or a low viscosity mineral base oil, the kinematic viscosities of lubricating oil at 40° C. and at 100° C. and the HTHS viscosity thereof at 100° C., which are effective for enhancing fuel efficiency, can be significantly reduced.

The third lubricating oil composition has excellent fuel savings and low temperature viscosity characteristics. While maintaining the HTHS viscosity at 150° C. without using a synthetic oil such as poly-α-olefin based base oil and ester based base oil, or a low viscosity mineral base oil, both requirements of the fuel savings and low temperature viscosity at −35° C. or lower can be achieved and, in particular, the kinematic viscosities of lubricating oil at 40° C. and at 100° C. and the HTHS viscosity thereof at 100° C. can be reduced and an MRV viscosity at −40° C. can be significantly improved.

The first, second and third lubricating oil compositions can be suitably used for gasoline engines, diesel engines and gas engines for two-wheel vehicles, four-wheel vehicles, power generation, cogeneration, and the like. Further, they can be suitably used not only for these various engines that use fuel containing a sulfur of 50 ppm by mass or less, but also for various engines for marine vessels and outboard motors. In addition, the first, second and third lubricating oil compositions are, due to excellent viscosity-temperature characteristics thereof, particularly effective for enhancing fuel efficiency of the engines having a roller tappet type valve train system.

BEST MODES FOR CARRYING OUT THE INVENTION

Preferred embodiments of the present invention will be described in detail below.

In the present invention, a kinematic viscosity at 40° C. or at 100° C. herein means the kinematic viscosity at 40° C. or at 100° C., respectively, defined in ASTM D-445.

A viscosity index herein means the viscosity index measured complying with JIS K 2283-1993.

A saturated component content here means the value (unit: % by mass) measured complying with ASTM D 2007-93. Proportions of naphthenic component content and paraffinic component content in the saturated component content mean the naphthenic component content (measuring object: 1- to 6-ring naphthene, unit: % by mass) and alkane content (unit: % by mass), respectively, measured complying with ASTM D 2786-91. For the methods of separating saturated component or in composition analysis of cyclic saturated component content, non-cyclic saturated component content, and the like, similar methods that would result in comparable results can be used. For example, besides those described above, the methods include the methods specified in ASTM D 2425-93 and in ASTM D 2549-91, a high-performance liquid chromatography (HPLC) method, and modified methods thereof.

In the present invention, later described aromatic component content in lubricating base oil (A) and lubricating base oil (B) means the value measured complying with ASTM D 2007-93. The aromatic components normally include anthracene, phenanthrene and alkylated compounds thereof, besides alkyl benzene and alkyl naphthalene, and further includes condensed ring compounds of four or more benzene rings and aromatic compounds containing hetero atoms of such as pyridines, quinolines, phenols, and naphthols. Meanwhile, a total aromatic component content in lubricating base oil (C) means the content of aromatic fraction measured complying with ASTM D 2549.

The terms % $C_P$, % $C_N$ and % $C_A$ herein mean the percentage of paraffin carbon atoms with respect to the total carbon atoms, the percentage of naphthene carbon atoms with respect to the total carbon atoms, and the percentage of aromatic carbon atoms with respect to the total carbon atoms, respectively, obtained by the method complying with ASTM D 3238-85 (n-d-M ring analysis). In other words, preferable ranges of the above-described % $C_P$, % $C_N$ and % $C_A$ are based on the values obtained by the above method and, for example, even in the case with lubricating base oil that contains no naphthenic component content, the % $C_N$ value obtained by the above method may indicate a value exceeding 0.

Nitrogen content here means the nitrogen content measured complying with JIS K 2609-1990.

Iodine value herein means the iodine value measured by the indicator titration method specified in JIS K 0070, Test methods for acid value, saponification value, iodine value, hydroxyl value and unsaponifiable matter of chemical products.

Pour point herein means the pour point measured complying with JIS K 2269-1987.

Aniline point herein means the aniline point measured complying with JIS K 2256-1985.

Density at 15° C. here means the density measured at 15° C. complying with JIS K 2249-1995.

Noack evaporation amount herein means the evaporation amount of lubricating oil measured complying with ASTM D 5800.

[First Embodiment]

A lubricating oil composition according to a first embodiment of the present invention (hereinafter referred to as a "first lubricating oil composition") comprises a lubricating base oil (hereinafter referred to as a "lubricating base oil (A)" for convenience) including a lubricating base oil component (hereinafter referred to as a "lubricating base oil component (a)" for convenience) having a urea adduct value of 4% by mass or less, a kinematic viscosity of 25 $mm^2/s$ or less at 40° C., and a viscosity index of 120 or more, in an amount of 10 to 100% by mass based on the total mass of the lubricating base oil.

The lubricating base oil component (a) may be any of a mineral base oil, a synthetic base oil, or a mixture of the both, as long as the urea adduct value, the kinematic viscosity at 40° C., and the viscosity index meet the above requirements.

It is preferable that, as the compatibility of requirements for viscosity-temperature characteristics, low temperature viscosity characteristics and heat conductivity can be achieved at a high level, the lubricating base oil component (a) is a mineral base oil, a synthetic base oil, or a combination of the both that are obtainable by hydrocracking and/or hydroisomerization of raw oil containing normal paraffin so that the urea adduct value becomes 4% by mass or less and the viscosity index becomes 120 or greater.

The urea adduct value of the lubricating base oil component (a), in view of improving low temperature viscosity characteristics and obtaining high heat conductivity without impairing viscosity-temperature characteristics, is necessary to be 4% by mass or less as described above and is preferably 3.5% by mass or less, more preferably 3% by mass or less, and even more preferably 2.5% by mass or less. While the urea adduct value of the lubricating base oil component could be 0% by mass, because of the fact that the lubricating base oil that has sufficient low temperature viscosity characteristics and a higher viscosity index and is economically superior by alleviating dewaxing conditions can be obtained, the urea adduct value is preferably 0.1% by mass or greater, more preferably 0.5% by mass or more, and particularly preferably 0.8% by mass or greater.

The kinematic viscosity of the lubricating base oil component (a) at 40° C. is necessary to be 25 $mm^2/s$ or less, and is preferably 22 $mm^2/s$ or less, more preferably 20 $mm^2/s$ or less, even more preferably 18 $mm^2/s$ or less, and specifically preferably 16 $mm^2/s$ or less. Meanwhile, the kinematic viscosity thereof at 40° C. is preferably 8 $mm^2/s$ or greater, more preferably 10 $mm^2/s$ or greater, even more preferably 12 $mm^2/s$ or greater, and particularly preferably 14 $mm^2/s$ or greater. When the kinematic viscosity of a lubricating base oil component at 40° C. exceeds 25 $mm^2/s$, the low temperature viscosity characteristics are deteriorated and sufficient fuel savings may not be obtainable and, when it is 8 $mm^2/s$ or less, the lubricity becomes poor due to insufficient formation of oil films at lubricating surfaces, and an evaporation loss of the lubricating oil composition may increase.

The kinematic viscosity of the lubricating base oil component (a) at 100° C. is preferably 6.0 $mm^2/s$ or less, more preferably 5.0 $mm^2/s$ or less, even more preferably 4.5 $mm^2/s$ or less, particularly preferably 4.0 $mm^2/s$ or less, and most preferably 3.9 $mm^2/s$ or less. On the other hand, the kinematic viscosity thereof at 100° C. is preferably 2.5 $mm^2/s$ or greater, more preferably 3.0 $mm^2/s$ or greater, even more preferably 3.3 $mm^2/s$ or greater, particularly preferably 3.5 $mm^2/s$ or greater, and most preferably 3.7 $mm^2/s$ or greater. In the case where the kinematic viscosity of a lubricating base oil component at 100° C. exceeds 6.0 $mm^2/s$, the low temperature viscosity characteristics are deteriorated and sufficient fuel savings may not be obtainable and, in the case where it is 2.5 $mm^2/s$ or less, the lubricity becomes poor due to insufficient formation of oil films at lubricating surfaces, and the evaporation loss of the lubricating oil composition may increase.

The viscosity index of the lubricating base oil component (a) is necessary to be 120 or greater, in order to obtain excellent viscosity characteristics from low temperature to high temperature and not to be volatile even at low viscosity, and is preferably 125 or greater, more preferably 130 or greater, even more preferably 135 or greater, and particularly preferably 140 or greater. The upper limit of the viscosity index is not specifically limited, and the ones having a viscosity index of about 125 to 180 such as normal paraffin, slack wax, and gas-to-liquid (GTL) wax, or an isoparaffin based mineral oil made by isomerizing thereof, or the ones having a viscosity index of about 150 to 250 such as a complex ester base oil and a high viscosity index polyalphaolefin (HVI-PAO) base oil may also be used. As for the normal paraffin, slack wax, GTL wax and the like, or isoparaffin based mineral oil that is the isomerized products thereof, however, in order to enhance low temperature viscosity characteristics, the viscosity index is preferably 180 or less, more preferably 160 or less, even more preferably 150 or less, and particularly preferably 145 or less.

The iodine value of the lubricating base oil component (a) is preferably 1 or less, more preferably 0.5 or less, even more preferably 0.3 or less, particularly preferably 0.15 or less, and most preferably 0.1 or less. While the iodine value could be below 0.01, due to its corresponding effect being small and its economic efficiency, it is preferably 0.001 or greater, more preferably 0.01 or greater, even more preferably 0.03 or greater, and particularly preferably 0.05 or greater. The fact that the iodine value of the lubricating base oil component is 0.5 or less can dramatically improve thermal and oxidation stability.

For the production of the lubricating base oil component (a), raw oil containing normal paraffin can be used. The raw oil may be any of mineral oil, synthetic oil, or a mixture of more than two types thereof. The content of normal paraffin in the raw oil, based on the total mass of the raw oil, is preferably 50% by mass or greater, more preferably 70% by mass or greater, even more preferably 80% by mass or greater, still more preferably 90% by mass or greater, particularly preferably 95% by mass or greater, and most preferably 97% by mass or greater.

Examples of the raw material containing wax include oil derived by solvent refining such as raffinate, partially solvent dewaxed oil, deasphalted oil, distillates, vacuum gas oil, coker gas oil, slack wax, foots oil, and Fischer-Tropsch wax. The slack wax and Fischer-Tropsch wax are preferable among them.

The slack wax is typically derived from hydrocarbon feedstock by solvent or propane dm axing. While the slack wax could contain residual oil, the residual oil can be removed by deoiling. The foots oil corresponds to the deoiled slack wax.

The Fischer-Tropsch wax can be produced by a method referred to as Fischer-Tropsch synthesis.

The raw oil derived by solvent extraction can be obtained by forwarding high boiling oil fraction from atmospheric distillation to a vacuum distillation device and by solvent extracting the distillate fraction from the device. The residue of vacuum distillation may be deasphalted. In solvent extraction, aromatic components are dissolved in extraction phase while highly paraffinic components remain in raffinate phase. Naphthene is distributed over the extraction phase and the raffinate phase. Preferable examples of the solvent used for solvent extraction may include phenol, furfural, and N-methylpyrrolidone. By controlling the ratio of solvent to oil, extraction temperature, and a contacting method of distillate to be extracted with solvent, the degree of separation between the extraction phase and the raffinate phase can be controlled. Further, by using a fuel oil hydrocracking device having a severe hydrocracking capability, the bottom distillate obtained from the fuel oil hydrocracking device may be used as raw oil.

The raw oil described above can undergo the process of hydrocracking and/or hydroisomerization such that the resultant of process obtained has a urea adduct value of 4% by mass or less and a viscosity index of 100 or greater, whereby the lubricating base oil component (a) can be obtained. The hydrocracking and/or hydroisomerization process is not specifically restricted as long as the urea adduct value and the viscosity index of the resultant of the process obtained meet the above conditions. A preferable method of the hydrocracking and/or hydroisomerization according to the present invention comprises:

a first step of hydrotreating raw oil containing normal paraffin using a hydrotreating catalyst, a second step of hydrodewaxing the product of the first process using a hydrodewaxing catalyst, and a third step of hydrorefining the product of the second process using a hydrorefining catalyst. For the product obtained after the third step, a predetermined component may be separated and removed by distillation and the like as necessary.

In the lubricating base oil component (a) obtained by the above method, as long as the urea adduct value, kinematic viscosity at 40° C. and viscosity index meet the respective requirements above, other properties are not specifically restricted. It is preferable that the lubricating base oil component (a) further satisfies the following requirements.

The saturated component content in the lubricating base oil component (a), based on the total mass of the lubricating base oil component (a), is preferably 90% by mass or greater, more preferably 93% by mass or greater, and even more preferably 95% by mass or greater. The proportion of naphthenic component content in the saturated component content is preferably 0.1 to 40% by mass, more preferably 1 to 30% by mass, even more preferably 5 to 20% by mass, and particularly preferably 10 to 15% by mass. The fact that the saturated component content and the proportion of naphthenic component content in the saturated component content meet their respective conditions above can achieve superior viscosity-temperature characteristics, low temperature viscosity characteristics, and thermal and oxidation stability. In the case where the lubricating base oil component (a) is mixed with additives, the additives are adequately dissolved and stably retained in the lubricating base oil component (a), and thus the functions of the additives can be expressed at higher levels. Further, the fact that the saturated component content and the proportion of naphthenic component content in the saturated component content meet their respective conditions above can improve friction characteristics of the lubricating base oil component (a) itself, resulting in that the enhancing of friction reduction effect and eventually the enhancing of energy saving characteristics can be achieved. When the saturated component content is below 90% by mass, the viscosity-temperature characteristics, thermal and oxidation stability, and friction characteristics are likely to become insufficient. In the case where the proportion of the naphthenic component content in the saturated component content is below 0.1% by mass, when the lubricating base oil component (a) is mixed with additives, as the solubility of the additives becomes inadequate and the effective amount of the additives dissolved and retained in the lubricating base oil component is reduced, the functions of the additives are not likely to be obtained effectively. In the case where the proportion of the cyclic saturated component content contained in the saturated component content exceeds 10% by mass, when the lubricating base oil component (a) is mixed with the additives, the effectiveness of the additives tends to be lowered.

In the present invention, the proportion of naphthenic component content in the saturated component content being 0.1 to 40% by mass is equivalent to the proportion of paraffinic component content in the saturated component content being 99.9 to 60% by mass. Here, the paraffinic component content includes both normal paraffin and isoparaffin. The proportion of normal paraffin and isoparaffinic component content in the lubricating base oil component (a) is not specifically restricted as long as the urea adduct value meets the above requirement. However, the proportion of isoparaffin, based on the total mass of the lubricating base oil component (a), is preferably 60 to 99.9% by mass, more preferably 70 to 99% by mass, even more preferably 80 to 95% by mass, and particularly preferably 85 to 90% by mass. The fact that the proportion of isoparaffinic component content in the lubricating base oil component (a) meets the above condition can further enhance the viscosity-temperature characteristics and thermal and oxidation stability. In the case where the lubricating base oil component (a) is mixed with additives, the additives are adequately dissolved and stably retained therein, and thus the functions of the additives can be expressed at even higher levels.

While the aromatic component content in the lubricating base oil component (a) is not specifically restricted, it is preferably 5% by mass or less, more preferably 2% by mass or less, even more preferably 1% by mass or less, particularly preferably 0.5% by mass or less, and most preferably 0.3% by mass or less. Although the total aromatic component content could be 0% by mass, in view of its corresponding effect being small, its economic efficiency and solubility of additives, it is preferably 0.01% by mass or greater, more preferably 0.05% by mass or greater, and even more preferably 0.1% by mass or greater. It is not preferable that the total aromatic component content in the base oil exceed 5% by mass, which deteriorates the oxidative stability.

While the sulfur content in the lubricating base oil component (a) is not specifically restricted, it is preferably 50 ppm by mass or less, more preferably 10 ppm by mass or less, even more preferably 5 ppm by mass or less, and particularly preferably 1 ppm by mass or less. The fact that the sulfur content is 50 ppm by mass or less can achieve superior thermal and oxidation stability.

While the pour point of the lubricating base oil component (a) depends on a viscosity grade of the lubricating base oil, the pour point is preferably −10° C. or lower, more preferably −12.5° C. or lower, even more preferably −15° C. or lower, most preferably −17.5° C. or lower, and specifically preferably −20° C. or lower. In the case where the pour point exceeds the upper limit value above, the low temperature fluidity of the lubricating oil using the lubricating base oil component as a whole may be deteriorated. Meanwhile, the pour point of the lubricating base oil component (a) is preferably −50° C. or higher, more preferably −40° C. or higher, even more preferably −30° C. or higher and particularly preferably −25° C. or higher. In the case where the pour point is below the lower limit value above, the viscosity index of the lubricating oil using the lubricating base oil component as a whole is deteriorated and thus the fuel savings may be degraded.

While the density ($\rho_{15}$) of the lubricating base oil component (a) at 15° C. depends on the viscosity grade of the lubricating base oil component, the density preferably equals to the value ρ represented by the following formula (A) or less, i.e., $\rho_{15} \leq \rho$.

$$\rho = 0.0025 \times kv100 + 0.816 \quad \text{(A)},$$

where kv100 represents the kinematic viscosity ($mm^2/s$) of the lubricating base oil component at 100° C.

In the case where the $\rho_{15} > \rho$, the viscosity-temperature characteristics, thermal and oxidation stability, and further the anti-volatility and low temperature viscosity characteristics are likely to be deteriorated, and thus the fuel savings may be degraded. In the case where the lubricating base oil component is mixed with additives, the effectiveness of the additives may be reduced.

More specifically, the density ($\rho_{15}$) of the lubricating base oil component (a) at 15° C. is preferably 0.840 or less, more preferably 0.830 or less, even more preferably 0.825 or less, and particularly preferably 0.822 or less.

The evaporation loss of the lubricating base oil component (a), as Noack evaporation amount, is preferably 20% by mass or less, more preferably 16% by mass or less, and particularly preferably 10% by mass or less. It is not preferable that the Noack evaporation amount of the lubricating base oil component (a) exceeds 20% by mass, which increases the evaporation loss of the lubricating oil and causes an increase in viscosity and the like.

In the first lubricating oil composition, as the lubricating base oil component (a), a single type of lubricating base oil that meets the requirements of a urea adduct value of 4% by mass or less, a kinematic viscosity of 25 $mm^2/s$ or less at 40° C., and a viscosity index of 120 or more may be used alone, or more than one type thereof may be used mixed together.

The content of the lubricating base oil component (a), based on the total mass of the lubricating base oil (A), is 10 to 100% by mass, preferably 30 to 98% by mass, more preferably 50 to 95% by mass, even more preferably 70 to 93% by mass, and most preferably 80 to 95% by mass. When the proportion of the content thereof is below 10% by mass, the required low temperature viscosity and fuel saving performance may not be obtainable.

While the lubricating base oil (A) can be constituted by the lubricating base oil component (a) alone, it may further include, besides the lubricating base oil component (a), mineral base oil, synthetic base oil, or any mixture of more than two types of the lubricating oil selected therefrom. However, in the case where the lubricating base oil component (a) is used together with other lubricating base oil components, it is necessary to make the proportion of the other lubricating base oil components, based on the total mass of the lubricating base oil (A), to be 90% by mass or less.

While the other lubricating base oil components used together with the lubricating base oil component (a) are not specifically restricted, examples of mineral base oil may include solvent refined mineral oil, hydrogenated mineral oil, hydrorefined mineral oil, and solvent dewaxed base oil having a kinematic viscosity of 1 to 100 $mm^2/s$ at 100° C.

Furthermore, examples of the synthetic base oil include poly-α-olefins or hydrogenated products thereof, isobutene oligomers or hydrogenated products thereof, isoparaffins, alkylbenzenes, alkylnaphthalenes, diesters (such as ditridecyl glutarate, di-2-ethylhexyl adipate, diisodecyl adipate, ditridecyl adipate, and di-2-ethylhexyl sebacate), polyol esters (such as trimethylolpropane caprylate, trimethylolpropane pelargonate, pentaerythritol 2-ethylhexanoate, and pentaerythritol pelargonate), polyoxyalkylene glycols, dialkyldiphenyl ethers, and polyphenyl ethers. Among them, poly-α-olefins are preferred. Examples of the poly-α-olefins include oligomers or co-oligomers of α-olefins typically having 2 to 32 carbon atoms, preferably having 6 to 16 carbon atoms (such as 1-octene oligomer, decene oligomer, and ethylene-propylene co-oligomer) and hydrogenated products thereof.

The production method of the poly-α-olefins is not specifically limited, but examples of the method include polymerization of α-olefins in the presence of a polymerization catalyst such as a Friedel-Crafts catalyst containing a complex of aluminum trichloride or boron trifluoride with water, an alcohol (such as ethanol, propanol, or butanol), carboxylic acid, or esters.

Furthermore, the poly(meth)acrylate based viscosity index improver contained in the first lubricating oil composition is a viscosity index improver including at least one (meth)acrylate structural unit represented by general formula (1):

[Chemical Formula 2]

(1)

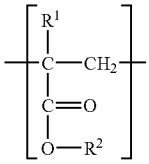

wherein $R^1$ represents hydrogen or a methyl group, and $R^2$ represents a straight or branched hydrocarbon group with 16 or more carbon atoms and wherein the proportion of the structural unit represented by general formula (1) is 0.5 to 70% by mole (hereinafter referred to as a "poly(meth)acrylate based viscosity index improver (a)"). The poly(meth)acrylate based viscosity index improver (a) may be either a non-dispersant type or dispersant type, but the dispersant type is more preferred.

As described above, $R^2$ in the structural unit represented by general formula (1) is a straight or branched hydrocarbon group with 16 or more carbon atoms, preferably straight or branched hydrocarbon with 18 or more carbon atoms, more preferably straight or branched hydrocarbon with 20 or more carbon atoms, and even more preferably a branched hydrocarbon group with 20 or more carbon atoms. Furthermore, the upper limit of the hydrocarbon group represented by $R^2$ is not specifically limited, but a straight or branched hydrocarbon group with 100 or less carbon atoms is preferable. The hydrocarbon group is more preferably straight or branched hydrocarbon with 50 or less carbon atoms, even more preferably straight or branched hydrocarbon with 30 or less carbon atoms, specifically preferably branched hydrocarbon with 30 or less carbon atoms, and most preferably branched hydrocarbon with 25 or less carbon atoms.

Furthermore, in the poly(meth)acrylate based viscosity index improver (a), the proportion of the (meth)acrylate structural unit represented by general formula (1) in the polymer is, as described above, 0.5 to 70% by mole, preferably 60% by mole or less, more preferably 50% by mole or less, even more preferably 40% by mole or less, and specifically preferably 30% by mole or less. Furthermore, the proportion is preferably 1% by mole or greater, more preferably 3% by mole or greater, even more preferably 5% by mole or greater, and specifically preferably 10% by mole or greater. When the proportion is more than 70% by mole, the improvement effect on the viscosity-temperature characteristics and the low temperature viscosity characteristics may be insufficient, and when the proportion is less than 0.5% by mole, the improvement effect on the viscosity-temperature characteristics may be insufficient.

The poly(meth)acrylate based viscosity index improver (a) may be a copolymer including any of (meth)acrylate structural units besides the (meth)acrylate structural unit represented by general formula (1). Such a copolymer can be obtained by copolymerizing one or more monomers represented by general formula (2):

[Chemical Formula 3]

(2)

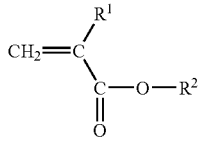

wherein $R^1$ represents a hydrogen atom or a methyl group, and $R^2$ represents a straight or branched hydrocarbon group with 16 or more carbon atoms (hereinafter referred to as a "monomer (M-1)") with monomers other than the monomer (M-1).

Any monomer can be combined with the monomer (M-1), but, for example, a monomer represented by general formula (3):

[Chemical Formula 4]

(3)

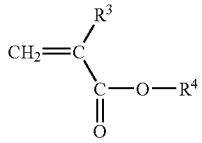

wherein $R^3$ represents a hydrogen atom or a methyl group, and $R^4$ represents a straight or branched hydrocarbon group with 1 to 15 carbon atom(s) (hereinafter referred to as a "monomer (M-2)") is preferred. The copolymer of the monomer (M-1) with the monomer (M-2) is a so-called non-dispersant poly(meth)acrylate based viscosity index improver.

Furthermore, other monomers combined with the monomer (M-1) are preferably one or more monomers selected from monomers represented by general formula (4):

[Chemical Formula 5]

(4)

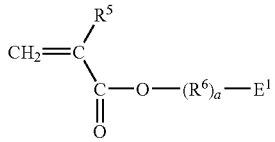

wherein $R^5$ represents a hydrogen atom or a methyl group, $R^6$ represents an alkylene group with 1 to 18 carbon atom(s), $E^1$ represents an amine residue or heterocyclic residue with 1 to 2 nitrogen atom(s) and 0 to 2 oxygen atoms, and a is 0 or 1 (hereinafter referred to as a "monomer (M-3)") and monomers represented by general formula (5) (hereinafter referred to as a "monomer (M-4)"). The copolymer of the monomer (M-1) with the monomers (M-3) and/or (M-4) is a so-called dispersant poly(meth)acrylate based viscosity index improver. Here, the dispersant poly(meth)acrylate based viscosity index improver may further contain the monomer (M-2) as a structural monomer.

Specific examples of the alkylene group with 1 to 18 carbon atom(s) represented by $R^6$ include an ethylene group, propylene group, butylene group, pentylene group, hexylene group, heptylene group, octylene group, nonylene group, decylene group, undecylene group, dodecylene group, tridecylene group, tetradecylene group, pentadecylene group, hexadecylene group, heptadecylene group, and octadecylene group (these alkylene groups may be straight or branched).

Furthermore, specific examples of the group represented by $E^1$ include a dimethylamino group, diethylamino group, dipropylamino group, dibutylamino group, anilino group, toluidino group, xylidino group, acetylamino group, benzoylamino group, morpholino group, pyrrolyl group, pyrrolino group, pyridyl group, methylpyridyl group, pyrrolidinyl group, piperidinyl group, quinonyl group, pyrrolidonyl group, pyrrolidono group, imidazolino group, and pyrazino group.

[Chemical Formula 6]

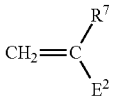

(5)

wherein $R^7$ represents a hydrogen atom or a methyl group, $E^2$ represents an amine residue or heterocyclic residue with 1 or 2 nitrogen atoms and 0 to 2 oxygen atoms.

Specific examples of the group represented by $E^2$ include a dimethylamino group, diethylamino group, dipropylamino group, dibutylamino group, anilino group, toluidino group, xylidino group, acetylamino group, benzoylamino group, morpholino group, pyrrolyl group, pyrrolino group, pyridyl group, methylpyridyl group, pyrrolidinyl group, piperidinyl group, quinonyl group, pyrrolidonyl group, pyrrolidono group, imidazolino group, and pyrazino group.

Preferred examples of the monomers (M-3) and (M-4) specifically include dimethylaminomethyl methacrylate, diethylaminomethyl methacrylate, dimethylaminoethyl methacrylate, diethylaminoethyl methacrylate, 2-methyl-5-vinylpyridine, morpholinomethyl methacrylate, morpholinoethyl methacrylate, N-vinylpyrrolidone, and mixtures thereof.

A copolymerization molar ratio of the copolymer of the monomer (M-1) with the monomers (M-2) to (M-4) is not specifically limited, but preferably the monomer (M-1): the monomers (M-2) to (M-4)=about 0.5:99.5 to 70:30, more preferably 5:90 to 50:50, and furthermore preferably 20:80 to 40:60.

The production method of the poly(meth)acrylate based viscosity index improver (a) is optional, but the agent can be easily obtained, for example, by radical-solution polymerization of a mixture of the monomer (M-1) with the monomers (M-2) to (M-4) in the presence of a polymerization initiator such as benzoyl peroxide.

The permanent shear stability index (PSSI) of the poly (meth)acrylate based viscosity index improver (a) is preferably 40 or less, more preferably 5 to 40, even more preferably 10 to 35, still more preferably 15 to 30, and particularly preferably 20 to 25. In the case where the PSSI exceeds 40, the shear stability may be deteriorated. In the case where the PSSI is below 5, enhancing effect of viscosity index is small and thus not only fuel savings and low temperature viscosity characteristics may become poor, but also cost increase may arise.

The weight average molecular weight ($M_w$) of the poly (meth)acrylate based viscosity index improver (a) is preferably 5,000 or greater, more preferably 50,000 or greater, even more preferably 100,000 or greater, particularly preferably 200,000 or greater, and most preferably 300,000 or greater. Further, it is preferably 1,000,000 or less, more preferably 700,000 or less, even more preferably 600,000 or less, and particularly preferably 500,000 or less. When the weight average molecular weight is below 5,000, the enhancing effect of viscosity index is small and thus not only fuel savings and low temperature viscosity characteristics may become poor, but also cost increase may arise. In the case where the weight average molecular weight exceeds 1,000,000, the shear stability, solubility to base oil, and storage stability may become deteriorated.

The ratio of the weight average molecular weight to the number average molecular weight ($M_w/M_n$) of the poly (meth)acrylate based viscosity index improver (a) is preferably 0.5 to 5.0, more preferably 1.0 to 3.5, even more preferably 1.5 to 3, and particularly preferably 1.7 to 2.5. In the case where the ratio of the weight average molecular weight and number average molecular weight becomes 0.5 or less, or becomes 5.0 or more, not only the solubility to base oil and storage stability are deteriorated, but also the viscosity-temperature characteristics are degraded, and thus the fuel savings may be deteriorated.

The ratio of the weight average molecular weight to PSSI ($M_w$/PSSI) of the poly(meth)acrylate based viscosity index improver (a) is $1\times10^4$ or more, preferably $1.5\times10^4$ or greater, more preferably $2\times10^4$ or greater, and even more preferably $2.5\times10^4$ or greater. In the case where the $M_w$/PSSI is below $1\times10^4$, the viscosity-temperature characteristics may be deteriorated, i.e., the fuel savings may be deteriorated.

The content of the poly(meth)acrylate based viscosity index improver (a), based on the total mass of the composition, is preferably 0.1 to 50% by mass, more preferably 0.5 to 40% by mass, even more preferably 1 to 30% by mass, and particularly preferably 5 to 20% by mass. In the case where the content of the poly(meth)acrylate based viscosity index improver (a) is 0.1% by mass or less, the enhancing effect of viscosity index and reduction effect of product viscosity become small, and thus the enhancing of fuel savings may not be achieved. When it is 50% by mass or more, the product cost is significantly increased and, as it becomes necessary to reduce the viscosity of base oil, the lubrication performance under a severe lubrication condition (high-temperature high-shear condition) is degraded and thus the concerns to cause problems such as wear, seizure and fatigue failure may arise.

The first lubricating oil composition may further include, besides the poly(meth)acrylate based viscosity index improver (a) described above, such as ordinary common non-dispersant or dispersant poly(meth)acrylates, non-dispersant or dispersant ethylene-α-olefin copolymers or hydrogenated products thereof, polyisobutylenes or hydrogenated products thereof, styrene-diene hydrogenated copolymers, styrene-maleic anhydride ester copolymers, and poly(alkyl)styrenes.

The first lubricating oil composition can further include, in order to enhance fuel saving performance, a friction modifier selected from organic molybdenum compounds and ashless friction modifiers.

Examples of the organic molybdenum compound used for the first lubricating oil composition include sulfur-containing organic molybdenum compounds such as molybdenum dithiophosphate and molybdenum dithiocarbamate.

Preferred examples of the molybdenum dithiocarbamate specifically include molybdenum sulfide diethyldithiocarbamate, molybdenum sulfide dipropyldithiocarbamate, molybdenum sulfide dibutyldithiocarbamate, molybdenum sulfide dipentyldithiocarbamate, molybdenum sulfide dihexyldithiocarbamate, molybdenum sulfide dioctyldithiocarbamate, molybdenum sulfide didecyldithiocarbamate, molybdenum sulfide didodecyldithiocarbamate, molybdenum sulfide di(butylphenyl)dithiocarbamate, molybdenum sulfide di(nonylphenyl)dithiocarbamate, molybdenum oxysulfide diethyldithiocarbamate, molybdenum oxysulfide dipropyldithiocarbamate, molybdenum oxysulfide dibutyldithiocarbamate, molybdenum oxysulfide dipentyldithiocarbamate, molybdenum oxysulfide dihexyldithiocarbamate, molybdenum oxysulfide dioctyldithiocarbamate, molybdenum oxysulfide didecyldithiocarbamate, molybdenum oxysulfide didodecyldithiocarbamate, molybdenum oxysulfide di(butylphenyl)dithiocarbamate, molybdenum oxysulfide di(nonylphenyl)dithiocarbamate (where each alkyl group may be straight or branched, and the bonding position of the alkyl group in each alkylphenyl group is optional), and mixtures thereof. Furthermore, molybdenum dithiocarbamates having hydrocarbon groups with different carbon numbers and/or structures in the molecule can be also preferably used as the molybdenum dithiocarbamate.

In addition, examples of the sulfur-containing organic molybdenum compound other than those exemplified above include complexes of molybdenum compounds (for example, molybdenum oxides such as molybdenum dioxide and molybdenum trioxide, molybdic acid such as orthomolybdic acid, paramolybdic acid, (poly)sulfurized molybdic acid, salts of molybdic acids such as metal salts and ammonium salts of the molybdic acids, molybdenum sulfides such as molybdenum disulfide, molybdenum trisulfide, molybdenum pentasulfide, and molybdenum polysulfide, sulfurized molybdic acid, metal salts or amine salts of sulfurized molybdic acid, halogenated molybdenums such as molybdenum chloride) with sulfur-containing organic compounds (for example, alkyl(thio)xanthates, thiadiazole, mercaptothiadiazole, thiocarbonate, tetrahydrocarbyithiuram disulfide, bis(di(thio)hydrocarbyldithio phosphonate)disulfide, organic (poly)sulfides, and sulfurized esters) or other organic compounds; and complexes of sulfur-containing molybdenum compounds such as the above molybdenum sulfides and sulfurized molybdic acid with alkenyl succinimides.

Furthermore, an organic molybdenum compound without sulfur as a constituent element may be used as the organic molybdenum compound.

Specific examples of the organic molybdenum compound without sulfur as a constituent element include molybdenum-amine complexes, molybdenum-succinimide complexes, molybdenum salts of organic acids, and molybdenum salts of alcohols. Among them, the molybdenum-amine complexes, molybdenum salts of organic acids, and molybdenum salts of alcohols are preferred.

In the first lubricating oil composition, when an organic molybdenum compound is used, the content is not specifically limited, but, on the basis of the total mass of compositions, as converted to a molybdenum element, the content is preferably 0.001% by mass or greater, more preferably 0.005% by mass or greater, and even more preferably 0.01% by mass or greater, as well as preferably 0.2% by mass or less, more preferably 0.1% by mass or less, more preferably 0.05% by mass or less, and specifically preferably 0.03% by mass or less. When the content is less than 0.001% by mass, the resulting lubricating oil composition has insufficient thermal and oxidation stability and thus specifically tends to be impossible to maintain excellent detergency for a long period. On the other hand, when the content is more than 0.2% by mass, the resulting lubricating oil composition fails to have sufficient effect as balanced with the content, as well as tends to decrease in storage stability.

The ashless friction modifier used for the first lubricating oil composition may be any compounds that are usually used as a friction modifier for lubricating oils. Examples of the ashless friction modifier include ashless friction modifiers of amine compounds, fatty acid esters, fatty acid amides, fatty acids, aliphatic alcohols, aliphatic ethers, or the like, each having at least one alkyl group or alkenyl group with 6 to 30 carbon atoms, specifically straight alkyl group or straight alkenyl group with 6 to 30 carbon atoms in the molecule. Further examples of the ashless friction modifier include one or more compounds selected from a group consisting of nitrogen-containing compounds represented by general formulas (6) and (7) and acid-modified derivatives thereof, and various ashless friction modifiers exemplified in International Publication WO 2005/037967 pamphlet.

[Chemical Formula 7]

(6)

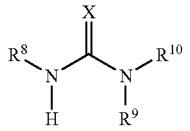

In general formula (6), $R^8$ is a hydrocarbon group with 1 to 30 carbon atom(s) or functionalized hydrocarbon group with 1 to 30 carbon atom(s), preferably a hydrocarbon group with 10 to 30 carbon atoms or functionalized hydrocarbon group with 10 to 30 carbon atoms, more preferably an alkyl group, alkenyl group, or functionalized hydrocarbon group with 12 to 20 carbon atoms, and specifically preferably an alkenyl group with 12 to 20 carbon atoms. Each of $R^9$ and $R^{10}$ independently represents a hydrocarbon group with 1 to 30 carbon atom(s), functionalized hydrocarbon group with 1 to 30 carbon atom(s), or hydrogen, preferably a hydrocarbon group with 1 to 10 carbon atom(s), functionalized hydrocarbon group with 1 to 10 carbon atom(s), or hydrogen, more preferably a hydrocarbon group with 1 to 4 carbon atom(s) or hydrogen, and even more preferably hydrogen. X represents oxygen or sulfur, and preferably oxygen.

[Chemical Formula 8]

(7)

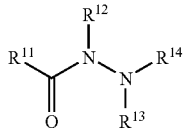

In general formula (7), $R^{11}$ is a hydrocarbon group with 1 to 30 carbon atom(s) or functionalized hydrocarbon group with 1 to 30 carbon atom(s), preferably a hydrocarbon group with 10 to 30 carbon atoms or functionalized hydrocarbon group with 10 to 30 carbon atoms, more preferably an alkyl group, alkenyl group, or functionalized hydrocarbon group with 12 to 20 carbon atoms, and specifically preferably an alkenyl group with 12 to 20 carbon atoms. Each of $R^{12}$, $R^{13}$, and $R^{14}$ independently represents a hydrocarbon group with 1 to 30 carbon atom(s), functionalized hydrocarbon group with 1 to 30 carbon atom(s), or hydrogen, preferably a hydrocarbon group with 1 to 10 carbon atom(s), functionalized hydrocarbon group with 1 to 10 carbon atom(s), or hydrogen, more preferably a hydrocarbon group with 1 to 4 carbon atom(s) or hydrogen, and even more preferably hydrogen.

Specific examples of the nitrogen-containing compound represented by general formula (7) include hydrazides having a hydrocarbon group with 1 to 30 carbon atom(s) or functionalized hydrocarbon group with 1 to 30 carbon atoms and derivatives thereof. When $R^{11}$ is a hydrocarbon group with 1 to 30 carbon atom(s) or functionalized hydrocarbon group with 1 to 30 carbon atoms and each of $R^{12}$ to $R^{14}$ is hydrogen, the nitrogen-containing compound is a hydrazide having a hydrocarbon group with 1 to 30 carbon atom(s) or functionalized hydrocarbon group with 1 to 30 carbon atom(s). When $R^{11}$ and any of $R^{12}$ to $R^{14}$ are hydrocarbon groups with 1 to 30 carbon atom(s) or functionalized hydrocarbon groups with 1 to 30 carbon atom(s) and the rest of $R^{12}$ to $R^{14}$ are hydrogen, the nitrogen-containing compound is an N-hydrocarbyl hydrazide having hydrocarbon groups each having 1 to 30 carbon atom(s) or functionalized hydrocarbon groups each having 1 to 30 carbon atom(s) wherein "hydrocarbyl" represents a hydrocarbon group or the like).

When an ashless friction modifier is used in the first lubricating oil composition, the content of the ashless friction modifier, based on the total mass of the composition, is preferably 0.01% by mass or greater, more preferably 0.1% by mass or greater, and even more preferably 0.3% by mass or greater, while it is preferably 3% by mass or less, more preferably 2% by mass or less, and even more preferably 1% by mass or less. In the case where the content of the ashless friction modifier is below 0.01% by mass, the friction reduction effect by the addition thereof tends to become insufficient and, in the case where the content exceeds 3% by mass, the effect of anti-wear additives or the like is likely to be inhibited or the solubility of the additives tends to be deteriorated.

In the first lubricating oil composition, while either one of the organic molybdenum compounds or ashless friction modifiers, or a combination of the both may be used, it is more preferable that an ashless friction modifier be used.

The first lubricating oil composition can further include, in order to enhance its performance, any of generally used additives in the lubricating oil according to its purpose. Such additives include the additives of, for example, a metallic detergent, ashless dispersant, antioxidant, anti-wear agent (or extreme pressure additive), corrosion inhibitor, rust inhibitor, pour point depressant, demulsifier, metal deactivator, and antifoaming agent.

Examples of the metallic detergent include normal salts, basic salts, or overbased salts such as alkali metal sulfonates or alkaline earth metal sulfonates, alkali metal phenates or alkaline earth metal phenates, and alkali metal salicylates or alkaline earth metal salicylates. In the present invention, one or more alkali metallic or alkaline earth metallic detergents selected from a group consisting of the above salts, specifically, the alkaline earth metallic detergents can be preferably used. In particular, magnesium salts and/or calcium salts are preferable and calcium salts are more preferably used.

The ashless dispersant may be any ashless dispersants used for lubricating oils. Examples of the ashless dispersant include mono- or bis-succinimides having at least one straight or branched alkyl group or alkenyl group with 40 to 400 carbon atoms in the molecule, benzylamines having at least one alkyl group or alkenyl group with 40 to 400 carbon atoms in the molecule, polyamines having at least one alkyl group or alkenyl group with 40 to 400 carbon atoms in the molecule, boron compounds thereof, and derivatives modified with carboxylic acids, phosphoric acid, or the like. Before use, one or more dispersants optionally selected from these compounds may be mixed.

Examples of the antioxidant include ashless antioxidants such as phenolic and aminic antioxidants and metallic antioxidants such as copper-containing and molybdenum-containing antioxidants. Specific examples of the phenolic ashless antioxidant include 4,4'-methylenebis(2,6-di-tert-butylphenol) and 4,4'-bis(2,6-di-tert-butylphenol). Specific examples of the aminic ashless antioxidant include phenyl-α-naphthylamine, alkylphenyl-α-naphthylamines, and dialkyldiphenylamines.

The anti-wear agent (or extreme pressure additive) may be any of anti-wear agents and extreme pressure additives that are used for lubricating oils. For example, sulfur-containing, phosphorus-containing, and sulfuric-phosphoric-containing extreme pressure additives may be used. Specific examples of the anti-wear agent include phosphorous acid esters, thiophosphorous acid esters, dithiophosphorous acid esters, trithiophosphorous acid esters, phosphoric acid esters, thiophosphoric acid esters, dithiophosphoric acid esters, trithiophosphoric acid esters, amine salts thereof, metal salts thereof, derivatives thereof, dithiocarbamates, zinc dithiocarbamates, molybdenum dithiocarbamates, disulfides, polysulfides, sulfurized olefins, and sulfurized fats and oils. Among them, the sulfuric extreme pressure additives are preferably added and sulfurized fats and oils are specifically preferred.

Examples of the corrosion inhibitor include benzotriazole-, tolyltriazole-, thiadiazole-, and imidazole-type compounds.

Examples of the rust inhibitor available include petroleum sulfonates, alkylbenzene sulfonates, dinonylnaphthalene sulfonates, alkenyl succinic acid esters, and polyhydric alcohol esters.

Examples of the pour point depressant include polymethacrylate polymers suitable for a lubricating base oil to be used.

Examples of the demulsifier include polyalkylene glycol-based non-ionic surfactants such as polyoxyethylene alkyl ethers, polyoxyethylene alkylphenyl ethers, and polyoxyethylene alkylnaphthyl ethers.

Examples of the metal deactivator include imidazolines, pyrimidine derivatives, alkylthiadiazoles, mercaptobenzothiazoles, benzotriazole and derivatives thereof, 1,3,4-thiadiazole polysulfide, 1,3,4-thiadiazolyl-2,5-bisdialkyldithiocarbamate, 2-(alkyldithio)benzoimidazole, and β-(o-carboxybenzylthio)propionitrile.

Examples of the antifoaming agent include silicone oil, alkenyl succinic acid derivatives, esters of polyhydroxy aliphatic alcohols and long-chain fatty acids, methyl salicylate, and o-hydroxybenzyl alcohol, with a kinematic viscosity of 0.1 to 100 $mm^2/s$ at 25° C.

When these additives are included in the first lubricating oil composition, the content of each of the respective additives, based on the total mass of the composition, is 0.01 to 10% by mass.

The kinematic viscosity of the first lubricating oil composition at 100° C. is necessary to be 4 to 12 $mm^2/s$, and is preferably 4.5 to 10 $mm^2/s$, more preferably 5 to 9 $mm^2/s$, and particularly preferably 6 to 8 $mm^2/s$. When the kinematic viscosity at 100° C. is below 4 $mm^2/s$, the lack of lubricity may result and, when the viscosity exceeds 12 $mm^2/s$, the required low temperature viscosity and sufficient fuel saving performance may not be obtainable.

The kinematic viscosity of the first lubricating oil composition at 40° C. is preferably 4 to 50 $mm^2/s$, more preferably 10 to 40 $mm^2/s$, even more preferably 20 to 35 $mm^2/s$, and particularly preferably 27 to 32 $mm^2/s$. In the case where the kinematic viscosity at 40° C. is below 4 $mm^2/s$, the lack of lubricity may result and, in the case where the viscosity exceeds 50 $mm^2/s$, the required low temperature viscosity and sufficient fuel saving performance may not be obtainable.

The viscosity index of the first lubricating oil composition is necessary to be in a range of 140 to 300, and is preferably 190 or greater, more preferably 200 or greater, even more preferably 210 or greater, and particularly preferably 220 or greater. In the case where the viscosity index of the first lubricating oil composition is below 140, the enhancing of fuel savings while maintaining HTHS viscosity may become difficult and, further, the reduction of low temperature viscosity at −35° C. may become difficult. When the viscosity index of the first lubricating oil composition exceeds 300, the low temperature fluidity is deteriorated and the problems by the lack of solubility of additives and compatibility with seal materials may further arise.

The HTHS viscosity of the first lubricating oil composition at 100° C. is preferably 3.0 to 5.5 mPa·s, more preferably 3.5 to 5.0 $mm^2/s$, even more preferably 4.0 to 4.9 mPa·s, particularly preferably 4.2 to 4.8 mPa·s, and most preferably 4.3 to 4.7 mPa·s. When the HTHS viscosity at 100° C. is below 3.0 mPa·s, the lack of lubricity may arise and, when the viscosity exceeds 5.5 mPa·s, the required low temperature viscosity and sufficient fuel saving performance may not be obtainable.

The HTHS viscosity of the first lubricating oil composition at 150° C. is preferably 2.0 to 3.5 mPa·s, more preferably 2.3 to 3.0 mPa·s even more preferably 2.4 to 2.8 mPa·s, and specifically preferably 2.5 to 2.7 mPa·s. In the case where the HTHS viscosity at 150° C. is below 2.0 mPa·s, the lack of lubricity may arise and, in the case where the viscosity exceeds 3.5 mPa·s, the required low temperature viscosity and sufficient fuel saving performance may not be obtainable.

[Second Embodiment]

A lubricating oil composition according to a second embodiment of the present invention (hereinafter referred to as a "second lubricating oil composition") comprises a lubricating base oil (hereinafter referred to as a "lubricating base oil (B)") having a kinematic viscosity of 1 to 10 $mm^2/s$ at 100° C. and a % $C_A$ of 5 or less, and a viscosity index improver having a weight average molecular weight of 50,000 or more and a ratio of the weight average molecular weight and PSSI of $0.8\times10^4$ or more, wherein the amount of the viscosity index improver is 0.1 to 50% by mass based on the total mass of the lubricating oil composition, the lubricating oil composition having a kinematic viscosity of 3 to 9.3 $mm^2/s$ at 100° C. and a ratio of HTHS viscosity at 150° C. to HTHS viscosity at 100° C. of 0.50 or more.

The lubricating base oil (B) is not specifically restricted as long as the kinematic viscosity at 100° C. and % $C_A$ meet the conditions above. Specific examples of the lubricating base oil (B) may include the base oil that meets the above conditions of the kinematic viscosity at 100° C. and % $C_A$ out of paraffin based mineral oil, normal paraffin based base oil, isoparaffin based base oil or the like that is produced by obtaining lubricating oil distillates from raw oil by atmospheric distillation and/or vacuum distillation and by refining them by a single or a combination of more than two types of refining process such as solvent deasphalting, solvent extracting, hydrocracking, solvent dewaxing, catalytic dewaxing, hydrorefining, sulfuric acid treating and clay treating.

Preferable examples of the lubricating base oil (B) include the base oil that is obtainable, with the base oil (1) to (8) illustrated in the description of the first embodiment as raw oil, by refining the raw oil and/or lubricating oil distillates collected therefrom in a predetermined refining method and by collecting the lubricating oil distillates thereof which meets the above conditions of the kinematic viscosity at 100° C. and % $C_A$, and the base oil that is selected from the base oil (1) to (8) or the base oil (9) or (10) obtainable by carrying out a predetermined process to the lubricating oil distillates collected therefrom which meets the above conditions of the kinematic viscosity at 100° C. and % $C_A$. As the refilling methods for the base oil (1) to (8), and the processing methods, catalysts used, reaction conditions or the like for the base oil (9) and (10) are the same as those of the first embodiment, the redundant descriptions are omitted here.

The kinematic viscosity of the lubricating base oil (B) at 100° C. is required to be 10 $mm^2/s$ or less, and is preferably 9 $mm^2/s$ or less, more preferably 7 $mm^2/s$ or less, even more preferably 5.0 $mm^2/s$ or less, particularly preferably 4.5 $mm^2/s$ or less, and most preferably 4.0 $mm^2/s$ or less. Meanwhile, the kinematic viscosity thereof at 100° C. is required to be 1 $mm^2/s$ or greater, and is preferably 1.5 $mm^2/s$ or greater, more preferably 2 $mm^2/s$ or greater, even more preferably 2.5 $mm^2/s$ or greater, and particularly preferably 3 $mm^2/s$ or greater. When the kinematic viscosity of a lubricating base oil component at 100° C. exceeds 10 $mm^2/s$, the low temperature viscosity characteristics are deteriorated and sufficient fuel savings may not be obtainable and, when it is 1 $mm^2/s$ or less, the lubricity becomes poor due to insufficient formation of oil films at lubrication points and the evaporation loss of the lubricating oil composition may increase.

According to the present invention, it is preferable that the lubricating base oil having a kinematic viscosity at 100° C. in the following ranges be sorted and used by distillation or the like.

(I) Lubricating base oil having a kinematic viscosity of 1.5 $mm^2/s$ or more but below 3.5 $mm^2/s$ at 100° C., and more preferably of 2.0 to 3.0 $mm^2/s$ (II) Lubricating base oil having a kinematic viscosity of 3.5 $mm^2/s$ or more but below 4.5 $mm^2/s$ at 100° C., and more preferably of 3.5 to 4.1 $mm^2/s$ (III) Lubricating base oil having a kinematic viscosity of 4.5 to 10 $mm^2/s$ at 100° C., more preferably of 4.8 to 9 $mm^2/s$, and particularly preferably of 5.5 to 8.0 $mm^2/s$ The kinematic viscosity of the lubricating base oil (B) at 40° C. is preferably 80 $mm^2/s$ or less, more preferably 50 $mm^2/s$ or less, even more preferably 20 $mm^2/s$ or less, particularly preferably 18 $mm^2/s$ or less, and most preferably 16 $mm^2/s$ or less. Meanwhile, the kinematic viscosity thereof at 40° C. is preferably 6.0 $mm^2/s$ or more, more preferably 8.0 $mm^2/s$ or more, even more preferably 12 $mm^2/s$ or more, particularly preferably 14 $mm^2/s$ or more, and most preferably 15 $mm^2/s$ or more. When the kinematic viscosity of a lubricating base oil component at 40° C. exceeds 80 $mm^2/s$, the low temperature viscosity characteristics are deteriorated and adequate fuel savings may not be obtainable and, when it is 6.0 $mm^2/s$ or less, the lubricity becomes poor due to insufficient formation of oil films at lubricating surfaces and an evaporation loss of the lubricating oil composition may increase. Further, according to the present invention, it is preferable that the lubricating oil distillates having a kinematic viscosity at 40° C. in the following ranges be sorted and used by distillation or the like.

(IV) Lubricating base oil having a kinematic viscosity of 6.0 $mm^2/s$ or more but below 12 $mm^2/s$ at 40° C., and more preferably of 8.0 to 12 $mm^2/s$ (V) Lubricating base oil having a kinematic viscosity of 12 $mm^2/s$ or more but below 28 $mm^2/s$ at 40° C., and more preferably of 13 to 19 $mm^2/s$ (VI) Lubricating base oil having a kinematic viscosity of 28 to 50 $mm^2/s$ at 40° C., more preferably of 29 to 45 $mm^2/s$, and particularly preferably of 30 to 40 $mm^2/s$ The viscosity index of the lubricating base oil (B) is preferably 120 or more. The viscosity indexes of the lubricating base oil (I) and (IV) are preferably 120 to 135, and more preferably 120 to 130. The viscosity indexes of the lubricating base oil (II) and (V) are preferably 120 to 160, more preferably 125 to 150, and even more preferably 135 to 145. The viscosity indexes of the lubricating base oil (III) and (VI) are preferably 120 to 180, and more preferably 125 to 160. In the case where the viscosity index is below the lower limit value above, not only the viscosity-temperature characteristics, thermal and oxidation stability, and anti-volatility become deteriorated but also a friction coefficient tends to be increased and anti-wear properties are likely to be deteriorated. When the viscosity index exceeds the upper limit value above, the low temperature viscosity characteristics are likely to be deteriorated.

While the density ($\rho_{15}$) of the lubricating base oil (B) at 15° C. depends on the viscosity grade of the lubricating base oil component, the density preferably equals to the value ρ or less, i.e., $\rho_{15} \leq \rho$, where ρ is represented by the formula (A) shown in the first embodiment. When the $\rho_{15} > \rho$, the viscosity-temperature characteristics, thermal and oxidation stability, and further the anti-volatility and low temperature viscosity characteristics are likely to be deteriorated, and thus the fuel savings may be degraded. In the case where the lubricating base oil composition is mixed with additives, the effectiveness of the additives may be reduced. More specifically, the density ($\rho_{15}$) of the lubricating base oil (B) at 15° C. is preferably 0.860 or less, more preferably 0.850 or less, even more preferably 0.840 or less, and particularly preferably 0.822 or less.

While the pour point of the lubricating base oil (B) depends on the viscosity grade of the lubricating base oil, for example, the pour points of the lubricating base oil (I) and (IV) are preferably −10° C. or lower, more preferably −12.5° C. or lower, and even more preferably −15° C. or lower. The pour points of the lubricating base oil (II) and (V) are preferably −10° C. or lower, more preferably −15° C. or lower, and even more preferably −17.5° C. or lower. The pour points of the lubricating base oil (III) and (VI) are preferably −10° C. or lower, more preferably −12.5° C. or lower, and even more preferably −15° C. or lower. In the case where the pour point exceeds the upper limit value above, the low temperature fluidity of the lubricating oil using the lubricating base oil as a whole tends to be deteriorated.

While the aniline point (AP(° C.)) of the lubricating base oil (B) depends on the viscosity grade of the lubricating base oil, the aniline point preferably equals to the value A represented by the following formula (B) or more, i.e., AP≥A.

$$A = 4.3 \times kv100 + 100 \quad (B)$$

where kv100 represents the kinematic viscosity ($mm^2/s$) of the lubricating base oil at 100° C.

In the case where the AP<A, the viscosity-temperature characteristics, thermal and oxidation stability, and further the anti-volatility and low temperature viscosity characteristics are likely to be deteriorated and, in the case where the lubricating base oil is mixed with additives, the effectiveness of the additives is likely to be reduced.

For example, the APs of the lubricating base oil (I) and (IV) are preferably 108° C. or higher, and more preferably 110° C. or higher. The APs of the lubricating base oil (II) and (V) are preferably 113° C. or higher, and more preferably 119° C. or higher. The APs of the lubricating base oil (III) and (VI) are preferably 125° C. or higher, and more preferably 128° C. or higher.

The iodine value of the lubricating base oil (B) is preferably 3 or less, more preferably 2 or less, even more preferably 1 or less, particularly preferably 0.9 or less, and most preferably 0.8 or less. While the iodine value could be below 0.01, due to its corresponding effect being small and its economic efficiency, it is preferably 0.001 or greater, more preferably 0.01 or greater, even more preferably 0.03 or greater, and particularly preferably 0.05 or greater. The fact that the iodine value of the lubricating base oil (B) is 3 or less can dramatically enhance the thermal and oxidation stability.

The sulfur content in the lubricating base oil (B) depends on the sulfur content in the raw material thereof. For example, when the raw material containing substantially no sulfur content such as synthetic wax components obtainable by Fischer-tropsch reaction or the like is used, the lubricating base oil containing substantially no sulfur content can be obtained. When the raw material containing sulfur such as slack wax obtainable during refining process of lubricating base oil or micro wax obtainable during wax refining process thereof is used, the sulfur content in the lubricating base oil obtained is typically 100 ppm by mass or greater. In the lubricating base oil (B), in view of the further enhancing of thermal and oxidation stability and reduction in sulfur, the sulfur content is preferably 100 ppm by mass or less, more preferably 50 ppm by mass or less, even more preferably 10 ppm by mass or less, and particularly preferably 5 ppm by mass or less.

The nitrogen content in the lubricating base oil (B), while it is not specifically restricted, is preferably 7 ppm by mass or less, more preferably 5 ppm by mass or less, and even more preferably 3 ppm by mass or less. In the case where the nitrogen content exceeds 5 ppm by mass, the thermal and oxidation stability is likely to be deteriorated.

The % $C_A$ of the lubricating base oil (B) is necessary to be 5 or less, and is more preferably 2 or less, even more preferably 1 or less, and particularly preferably 0.5 or less. In the case where the % $C_A$ of the lubricating base oil exceeds the upper limit value above, the viscosity-temperature characteristics, thermal and oxidation stability, and friction characteristics are likely to de deteriorated. While the % $C_A$ of the lubricating base oil (B) could be 0, by making the % $C_A$ to be the lower limit value above or more, the solubility of additives can further be enhanced.

The % $C_P$ of the lubricating base oil (B) is preferably 70 or more, more preferably 80 to 99, even more preferably 85 to 95, still more preferably 87 to 94, and particularly preferably 90 to 94. In the case where the % $C_P$ of the lubricating base oil is below the lower limit value above, the viscosity-temperature characteristics, thermal and oxidation stability, and friction characteristics are likely to de deteriorated and, when the lubricating base oil is mixed with additives, the effectiveness of the additives is likely to be lowered. In the case where the % $C_p$ of the lubricating base oil exceeds the upper limit value above, the solubility of additives is likely to be reduced.

The % $C_N$ of the lubricating base oil (B) is preferably 30 or less, more preferably 4 to 25, even more preferably 5 to 13, and particularly preferably 5 to 8. In the case where the % $C_N$ of the lubricating base oil exceeds the upper limit value above, the viscosity-temperature characteristics, thermal and oxidation stability, and friction characteristics are likely to de deteriorated. In the case where the % $C_N$ is below the lower limit value above, the solubility of additives is likely to be reduced.

The saturated component content in the lubricating base oil (B), based on the total mass of the lubricating base oil, while it is not specifically restricted as long as the kinematic viscosity at 100° C. and % $C_A$ meet the above conditions, is preferably 90% by mass or greater, more preferably 95% by mass or greater, and even more preferably 99% by mass or greater. The proportion of cyclic saturated component content contained in the saturated component content is preferably 40% by mass or less, more preferably 35% by mass or less, even more preferably 30% by mass or less, still more preferably 25% by mass or less, and yet more preferably 21% by mass or less. The fact that the saturated component content and the proportion of cyclic saturated component content contained in the saturated component meet the respective conditions above allows the viscosity-temperature characteristics and thermal and oxidation stability to be enhanced and, in the case where the lubricating base oil (B) is mixed with additives, the additives are sufficiently dissolved and stably retained therein, and thus the functions of the additives can be expressed at even higher levels. In addition, the friction characteristics of the lubricating base oil (B) itself can be improved and, as a result, improvement of friction reduction effect and eventually improvement in energy savings can be achieved.

While the aromatic component content in the lubricating base oil (B) is not specifically restricted as long as the kinematic viscosity at 100° C. and % $C_A$ meet the above conditions, the content based on the total mass of the lubricating base oil is preferably 5% by mass or less, more preferably 4% by mass or less, and even more preferably 3% by mass or less, and is preferably 0.1% by mass or more, more preferably 0.5% by mass or more, even more preferably 1% by mass or greater, and particularly preferably 1.5% by mass or greater. When the aromatic component content exceeds the upper limit value above, the viscosity-temperature characteristics, thermal and oxidation stability, friction characteristics, and further the anti-volatility and low temperature viscosity characteristics are likely to be deteriorated. Further, when the lubricating base oil is mixed with additives, the effectiveness of the additives is likely to be reduced. While the lubricating base oil (B) may contain no aromatic component, by making the aromatic component content to be the lower limit value above or more, the solubility of additives can further be enhanced.

The urea adduct value of the lubricating base oil (B), in view of improving low temperature viscosity characteristics and obtaining high heat conductivity without impairing the viscosity-temperature characteristics, is preferably 5% by mass or less, more preferably 3% by mass or less, even more preferably 2.5% by mass or less, and particularly preferably 2% by mass or less. While the urea adduct value of the lubricating base oil (B) could be 0% by mass, in terms of obtaining the lubricating base oil having sufficient low temperature viscosity characteristics and a higher viscosity index and being economically superior by alleviating dewaxing conditions, it is preferably 0.1% by mass or greater, more preferably 0.5% by mass or greater, and particularly preferably 0.8% by mass or greater.

In the second lubricating oil composition, while the above-described lubricating base oil (B) may be used alone, the lubricating base oil (B) may be used together with a single or more than one type of other base oil. In the case where the lubricating base oil (B) is used together with the other base oil, the proportion of the lubricating base oil (B) contained in the combined base oil is preferably 30% by mass or greater, more preferably 50% by mass or greater, and even more preferably 70% by mass or greater.

While the other base oil used in combination with the lubricating base oil (B) is not specifically restricted, examples of mineral base oil may include solvent refined mineral oil, hydrogenated mineral oil, hydrorefined mineral oil, and solvent dewaxed base oil having a kinematic viscosity of 1 to 100 $mm^2/s$ at 100° C. but not satisfying the condition of % $C_A$. Examples of synthetic base oil may include the synthetic oil shown in the first embodiment in the foregoing but not satisfying the above condition of the kinematic viscosity at 100° C.

The second lubricating oil composition contains a viscosity index improver (hereinafter referred to as a "viscosity index improver (B)") having a weight average molecular weight of 50,000 or more and a ratio of the weight average molecular weight and PSSI of $0.8\times10^4$ or more, in an amount of 0.1 to 50% by mass based on the total mass of the lubricating oil composition.

The viscosity index improver (B) is not specifically limited as long as the weight average molecular weight and the ratio of the weight average molecular weight and PSSI meet the above condition. Specific examples of the agent include non-dispersant or dispersant poly(meth)acrylates, non-dispersant or dispersant ethylene-α-olefin copolymers or hydrogenated products thereof, polyisobutylenes or hydrogenated products thereof, styrene-diene hydrogenated copolymers, styrene-maleic anhydride ester copolymers, and polyalkylstyrenes, each having a weight average molecular weight of 50,000 or greater and a ratio of the weight average molecular weight and PSSI of $0.8\times10^4$ or more. The viscosity index improver (B) may be either a non-dispersant or dispersant, but the dispersant is more preferable.

Preferred examples of the viscosity index improver (B) include agents containing one or more structural units of (meth)acrylate represented by general formula (1) described in the above first embodiment at a concentration of 1 to 70% by mole (hereinafter referred to as a "poly(meth)acrylate based viscosity index improver (b)"). The poly(meth)acrylate based viscosity index improver (b) may be either non-dispersant or dispersant, but the dispersant is more preferable.

Furthermore, in the poly(meth)acrylate based viscosity index improver (b), the proportion of the (meth)acrylate structural unit represented by general formula (1) in the polymer is preferably 1 to 70% by mole, more preferably 60% by mole or less, even more preferably 50% by mole or less, furthermore preferably 40% by mole or less, and specifically preferably 30% by mole or less. Furthermore, the proportion is preferably 3% by mole or greater, more preferably 5% by mole or greater, and specifically preferably 10% by mole or greater. When the proportion is more than 70% by mole, the improvement effect on the viscosity-temperature characteristics and the low temperature viscosity characteristics may be insufficient, and when the proportion is less than 0.5% by n ole, the improvement effect on the viscosity-temperature characteristics may be insufficient.

The poly(meth)acrylate based viscosity index improver (b) can include, besides the (meth)acrylate structural unit represented by General Formula (1), any (meth)acrylate structural units or any structural units derived from olefins and the like. A preferred embodiment of the poly(meth)acrylate based viscosity index improver includes a copolymer obtainable by polymerizing a single or more than one type of monomer (M-1) shown in the first embodiment above with a monomer other than the monomer (M-1). While any monomer can be combined with the monomer (M-1), for example, a single or more than one type of monomer selected from the monomers (M-2), (M-3), and (M-4) shown in the description of the first embodiment is suitable. The specific examples and copolymerization molar ratios of the monomers (M-2) to (M-4), methods for manufacturing the viscosity index improver (B) and the like are the same as those shown in the first embodiment and thus their redundant descriptions are omitted here.

The permanent shear stability index (PSSI) of the poly (meth)acrylate based viscosity index improver (b) is preferably 40 or less, more preferably 35 or less, even more preferably 30 or less, and particularly preferably 25 or less. Further, the PSSI of the poly(meth)acrylate based viscosity index improver (b) is preferably 5 or greater, more preferably 10 or greater, even more preferably 15 or greater, and particularly preferably 20 or greater. In the case where the PSSI exceeds 40, the shear stability may be deteriorated. In the case where the PSSI is below 5, enhancing effect of viscosity index is small and thus not only the fuel savings and low temperature viscosity characteristics may become poor, but also cost increase may arise.

The weight average molecular weight ($M_w$) of the poly (meth)acrylate based viscosity index improver (b) is necessary to be 50,000 or more, and is more preferably 100,000 or greater, even more preferably 150,000 or greater, particularly preferably 180,000 or greater, and most preferably 200,000 or greater. Meanwhile, it is also preferably 1,000,000 or less, more preferably 700,000 or less, even more preferably 600,000 or less, and particularly preferably 500,000 or less. In the case where the weight average molecular weight is below 50,000, the enhancing effect of viscosity index is small and thus not only fuel savings and low temperature viscosity characteristics may be poor, but also cost increase may arise. In the case where the weight average molecular weight exceeds 1,000,000, the shear stability, solubility to base oil, and storage stability may be deteriorated.

The ratio of the weight average molecular weight to the number average molecular weight ($M_w/M_n$) of the poly (meth)acrylate based viscosity index improver (b) is preferably 0.5 to 5.0, more preferably 1.0 to 3.5, even more preferably 1.5 to 3, and particularly preferably 1.7 to 2.5. In the case where the ratio of weight average molecular weight to the number average molecular weight is below 0.5 or exceeds 5.0, not only the solubility to base oil and storage stability are deteriorated, but also the viscosity-temperature characteristics are degraded, and thus the fuel savings may be deteriorated.

The ratio of the weight average molecular weight to PSSI ($M_w$/PSSI) of the poly(meth)acrylate based viscosity index improver (b) is necessary to be $0.8\times10^4$ or greater, and is preferably $1.0\times10^4$ or greater, more preferably $2\times10^4$ or more, and even more preferably $2.5\times10^4$ or greater. In the case where the $M_w$/PSSI is below $0.8\times10^4$, the viscosity-temperature characteristics may be deteriorated, i.e., the fuel savings may be deteriorated.

The content of the poly(meth)acrylate based viscosity index improver (b), based on the total mass of the composition, is necessary to be 0.1 to 50% by mass, and is preferably 0.5 to 40% by mass, more preferably 1 to 30% by mass, and particularly preferably 5 to 20% by mass. In the case where the content of the poly(meth)acrylate based viscosity index improver (b) is 0.1% by mass or less, enhancing effect of viscosity index and reduction effect of product viscosity becomes small, and thus the enhancing of fuel savings may not be achieved. In the case where it is 50% by mass or more, the product cost is significantly increased and, as it becomes necessary to reduce the viscosity of base oil, the lubrication performance under a severe lubrication condition (high-temperature high-shear condition) may be degraded and the concerns to cause problems such as wear, seizure and fatigue failure may arise.

The second lubrication oil composition may further include, besides the viscosity index improver according to the present invention described in the foregoing, ordinary common non-dispersant or dispersant poly(meth)acrylates, non-dispersant or dispersant ethylene-α-olefin copolymers or hydrogenated products thereof, polyisobutylenes or hydrogenated products thereof, styrene-diene hydrogenated copolymers, styrene-maleic anhydride ester copolymers, and poly (alkyl)styrenes.

In the second lubricating oil composition, in order to enhance the fuel saving performance, a friction modifier selected from organic molybdenum compounds and ashless friction modifiers can further be included. The specific examples and use of the organic molybdenum compounds and ashless friction modifiers are the same as those of the first embodiment, and thus their redundant descriptions are omitted here.

In the second lubricating oil composition, in order to further enhance its performance, any of generally used additives can be included in the lubricating oil according to its purpose. Such additives include the additives of, for example, a metallic detergent, ashless dispersant, antioxidant, anti-wear agent (or extreme pressure additive), corrosion inhibitor, rust inhibitor, pour point depressant, demulsifier, metal deactivator, and antifoaming agent. The specific examples and use of the additives are the same as those of the first embodiment, and thus their redundant descriptions are omitted here.

The kinematic viscosity of the second lubricating oil composition at 100° C. is necessary to be 3 to 9.3 $mm^2/s$, and is preferably 8.5 $mm^2/s$ or less, more preferably 8 $mm^2/s$ or less, even more preferably 7.8 $mm^2/s$ or less, and particularly preferably 7.6 $mm^2/s$ or less. Meanwhile, the kinematic viscosity of the second lubricating oil composition at 100° C. is preferably 4 $mm^2/s$ or greater, more preferably 5 $mm^2/s$ or greater, even more preferably 6 $mm^2/s$ or greater, and particularly preferably 7 $mm^2/s$ or greater. In the case where the kinematic viscosity at 100° C. is below 3 $mm^2/s$, the lack of lubricity may result and, in the case where the viscosity exceeds 9.3 $mm^2/s$, the required low temperature viscosity and sufficient fuel saving performance may not be obtainable.

The kinematic viscosity of the second lubricating oil composition at 40° C. is preferably 4 to 50 $mm^2/s$, more preferably 40 $mm^2/s$ or less, even more preferably 35 $mm^2/s$ or less, particularly preferably 32 $mm^2/s$ or less, and most preferably 30 $mm^2/s$ or less. Furthermore, the kinematic viscosity of the second lubricating oil composition at 40° C. is preferably 10 $mm^2/s$ or greater, more preferably 20 $mm^2/s$ or greater, even more preferably 25 $mm^2/s$ or greater, and particularly preferably 27 $mm^2/s$ or greater. When the kinematic viscosity at 40° C. is below 4 $mm^2/s$, the lack of lubricity may result and, when the viscosity exceeds 50 $mm^2/s$, the required low temperature viscosity and sufficient fuel saving performance may not be obtainable.

The viscosity index of the second lubricating oil composition is preferably in a range of 140 to 300, more preferably 190 or greater, even more preferably 200 or greater, still more preferably 210 or greater, and particularly preferably 220 or greater. In the case where the viscosity index of the second lubricating oil composition is below 140, the enhancing of fuel savings while maintaining HTHS viscosity may become difficult and further the reduction of low temperature viscosity at −35° C. may become difficult. In the case where the viscosity index of the second lubricating oil composition exceeds 300, the low temperature fluidity is deteriorated and further the problems by the lack of solubility of additives and compatibility with seal materials may arise.

The HTHS viscosity of the second lubricating oil composition at 150° C. is preferably 3.5 mPa·s or less, more preferably 3.0 mPa·s or less, even more preferably 2.8 mPa·s or less, and particularly preferably 2.7 mPa·s or less. Meanwhile, it is preferably 2.0 mPa·s or more, more preferably 2.3 mPa·s or more, even more preferably 2.4 mPa·s or more, particularly preferably 2.5 mPa·s or more, and most preferably 2.6 mPa·s or more. In the case where the HTHS viscosity at 150° C. is below 2.0 mPa·s, the lack of lubricity may arise and, in the case where the viscosity exceeds 3.5 mPa·s, the required low temperature viscosity and sufficient fuel saving performance may not be obtainable.

The HTHS viscosity of the second lubricating oil composition at 100° C. is preferably 5.3 mPa·s or less, more preferably 5.0 mPa·s or less, even more preferably 4.8 mPa·s or less, and particularly preferably 4.7 mPa·s or less. Further, it is preferably 3.5 mPa·s or greater, more preferably 3.8 mPa·s or greater, particularly preferably 4.0 mPa·s or greater, and most preferably 4.2 mPa·s or greater. In the case where the HTHS viscosity at 100° C. is below 3.5 mPa·s, the lack of lubricity may arise and, in the case where the viscosity exceeds 5.3 mPa·s, the required low temperature viscosity and sufficient fuel saving performance may not be obtainable.

The ratio of the HTHS viscosity at 150° C. to the HTHS viscosity at 100° C. (HTHS viscosity at 150° C./HTHS viscosity at 100° C.) of the second lubricating oil composition is necessary to be 0.50 or greater, and is more preferably 0.52 or greater, even more preferably 0.54 or greater, particularly preferably 0.55 or greater, and most preferably 0.56 or greater. In the case where the ratio thereof is below 0.50, the required low temperature viscosity and sufficient fuel saving performance may not be obtainable.

The second lubricating oil composition has excellent fuel savings and lubricity and, while the HTHS viscosity is maintained at a constant level without using synthetic oil such as poly-α-olefin based base oil and ester based base oil, or low viscosity mineral base oil, the kinematic viscosities of lubricating oil at 40° C. and at 100° C. and the HTHS viscosity thereof at 100° C., which are effective for enhancing fuel efficiency, have been significantly reduced. The second lubricating oil composition having such excellent properties can be suitably used as fuel saving engine oil for fuel saving gasoline engine oil, fuel saving diesel engine oil, and the like.

[Third Embodiment]

A lubricating oil composition according to a third embodiment of the present invention (hereinafter referred to as a "third lubricating oil composition") comprises:

a lubricating base oil (hereinafter referred to as a "lubricating base oil (C)") including a lubricating base oil component (hereinafter referred to as a "lubricating base oil component (c)" for convenience) having a saturated component content of 95% by mass or greater, a proportion of a cyclic saturated component content of 60% by mass or less contained in the saturated component, a viscosity index of 120 or more, and ϵ-methylene content in total constituent carbons at a proportion of 15 to 20%, and a viscosity index improver having a weight average molecular weight of 50,000 or more and a ratio of the weight average molecular weight and PSSI of $1\times10^4$ or more, in an amount of 0.1 to 50% by mass based on the total mass of the lubricating oil composition, the lubricating oil composition having a kinematic viscosity of 3.0 to 12.0 $mm^2/s$ at 100° C. and a ratio of the HTHS viscosity at 150° C. to HTHS viscosity at 100° C. of 0.50 or greater.

The lubricating base oil component (c) can be any of mineral base oil, synthetic base oil, or a mixture of the both, as long as the saturated component content, cyclic saturated component content contained in the saturated component, viscosity index, and proportion of ϵ-methylene content in the total constituent carbons meet the above requirements.

Preferable examples of the lubricating base oil component (c) may include, for satisfying all requirements of the viscosity-temperature characteristics, low temperature viscosity characteristics, and heat conductivity at high-level, mineral base oil, synthetic base oil, and a mixture of the both that are obtainable by hydrocracking/hydroisomerization of raw oil containing normal paraffin so as to have a saturated component content of 95% by mass or greater, a cyclic saturated component content of 60% by mass or less contained in the saturated component, a viscosity index of 120 or more and ϵ-methylene content in the total constituent carbons at a proportion of 15 to 20%.

The saturated component content in the lubricating base oil component (c), based on the total mass of the lubricating base oil component (c), is necessary to be 95% by mass or greater, and is more preferably 98% by mass or greater, even more preferably 99% by mass or greater, and particularly preferably 99.5% by mass or greater. The fact that the saturated component content meets the above requirement can achieve excellent viscosity-temperature characteristics, low temperature viscosity characteristics, and thermal and oxidation stability. In the case where the saturated component content is below 95% by mass, the viscosity-temperature characteristics, thermal and oxidation stability, and friction characteristics tend to become inadequate.

The cyclic saturated component content in the saturated component content of the lubricating base oil component (c) is necessary to be 60% by mass or less, and is preferably 40% by mass or less, more preferably 20% by mass or less, even more preferably 15% by mass or less, and particularly preferably 13% by mass or less, while it is preferably 0.1% by mass or greater, more preferably 1% by mass or greater, even more preferably 5% by mass or greater, and particularly preferably 10% by mass or greater. The fact that the proportion of the cyclic saturated component in the saturated component content meets the above condition can achieve excellent viscosity-temperature characteristics, low temperature viscosity characteristics, and thermal and oxidation stability and, in the case where the lubricating base oil (C) is mixed with additives, the additives can be sufficiently dissolved and stably retained in the lubricating base oil (C), and thus the functions of the additives can be expressed at higher levels. Further, the friction characteristics of the lubricating base oil (C) itself can be improved and, as a result, improvement of friction reduction effect and eventually improvement in energy savings can be achieved. When the proportion of the cyclic saturated component content in the saturated component is below 0.1% by mass, in the case where the lubricating base oil component is mixed with additives, as the solubility of the additives becomes inadequate and thus the effective amount of the additives dissolved and retained in the lubricating base oil component is reduced, the functions of the additives are not likely to be obtained efficiently. In the case where the proportion of the cyclic saturated component content in the saturated component exceeds 60% by mass, when the lubricating base oil component is mixed with additives, the effectiveness of the additives are likely to be reduced.

The kinematic viscosity of the lubricating base oil component (c) at 40° C., while it is not specifically restricted, is preferably 25 $mm^2/s$ or less, more preferably 22 $mm^2/s$ or less, even more preferably 20 $mm^2/s$ or less, and particularly preferably 18 $mm^2/s$ or less. On the other hand, the kinematic viscosity thereof at 40° C. is preferably 8 $mm^2/s$ or greater, more preferably 10 $mm^2/s$ or greater, even more preferably 12 $mm^2/s$ or greater, and particularly preferably 14 $mm^2/s$ or greater. When the kinematic viscosity of the lubricating base oil component (c) at 40° C. exceeds 25 $mm^2/s$, the low temperature viscosity characteristics may be deteriorated and, when it is 8 $mm^2/s$ or less, the lubricity may be poor due to insufficient formation of oil films at lubricating surfaces and an evaporation loss of the lubricating oil composition may increase.

The kinematic viscosity of the lubricating base oil component (c) at 100° C. is preferably 6.0 $mm^2/s$ or less, more preferably 5.0 $mm^2/s$ or less, even more preferably 4.5 $mm^2/s$ or less, particularly preferably 4.0 $mm^2/s$ or less, and most preferably 3.9 $mm^2/s$ or less. Meanwhile, the kinematic viscosity thereof at 100° C. is preferably 2.5 $mm^2/s$ or greater, more preferably 3.0 $mm^2/s$ or greater, even more preferably 3.3 $mm^2/s$ or greater, particularly preferably 3.5 $mm^2/s$ or greater, and most preferably 3.7 $mm^2/s$ or greater. When the kinematic viscosity of a lubricating base oil component at 100° C. exceeds 6.0 $mm^2/s$, the low temperature viscosity characteristics are deteriorated and sufficient fuel savings may not be obtainable and, when it is 2.5 $mm^2/s$ or less, the lubricity may be poor due to insufficient formation of oil films at lubricating surfaces and the evaporation loss of the lubricating oil composition may increase.

The viscosity index of the lubricating base oil component (c) is necessary to be 120 or greater, in order to obtain excellent viscosity characteristics from low temperature to high temperature and to be hard to evaporate even in low viscosity, and is preferably 125 or greater, more preferably 130 or greater, even more preferably 135 or greater, and particularly preferably 140 or greater. The upper limit of the viscosity index is not specifically limited, and the ones having a viscosity index of about 125 to 180 such as normal paraffin, slack wax, gas-to-liquid (GTL) wax and the like, or isoparaffin based mineral oil that is isomerized products thereof, or the ones having a viscosity index of about 150 to 250 such as complex ester base oil and HVI-PAO base oil may also be used. For normal paraffin, slack wax, GTL wax and the like, or isoparaffin based mineral oil that is isomerized products thereof, however, in order to enhance low temperature viscosity characteristics, the viscosity index is preferably 180 or less, more preferably 160 or less, even more preferably 150 or less, and particularly preferably 145 or less.

The proportion of ϵ-methylene content contained in total carbon in hydrocarbon constituting the lubricating base oil component (c) is 15 to 20% as described in the foregoing. The range of ϵ-methylene content is preferably 15.5 to 19%, more preferably 16 to 18%, and particularly preferably 16 to 17%. When the proportion of ϵ-methylene content becomes below 15%, the viscosity-temperature characteristics, fuel savings, and thermal and oxidation stability are likely to be deteriorated. When the proportion exceeds 20%, the low temperature viscosity characteristics, solubility and stability of additives, and friction characteristics are deteriorated.

While the proportion of ϵ-methylene content contained in total carbon constituting the lubricating base oil component (c) means the proportion of the total integrated intensity attributed to the $CH_2$ main chain to the total integrated intensity of total carbon measured by $^{13}C$-NMR, as long as equivalent results are obtainable, other methods may be used instead. In $^{13}C$-NMR measurement, 3 grams of deuterated chloroform added to 0.5 grams of specimen and diluted was used as a sample, and the measurement was made at room temperature and at a resonant frequency of 100 MHz using a gated decoupling method as a measurement method.

According to the above analysis, (a) Total integrated intensity of chemical shift ranging about 10 to about 50 ppm (total integrated intensity attributed to total carbon of hydrocarbon), and (b) Total integrated intensity of chemical shift ranging from 29.7 to 30.0 ppm (total integrated intensity attributed to ϵ-methylene) are measured, and the proportion (%) of (b) to (a) with a value of (a) as 100% was calculated. The proportion of (b) represents the proportion of ϵ-methylene content with respect to total carbon atoms constituting the base oil.

The proportion of ϵ-methylene content here represents the proportion of carbon atoms that are derived from carbon atoms on the main chain except for four carbon atoms (α carbon, β carbon, γ carbon, and δ carbon) from molecular ends on the main chain and branched ends having a certain chemical shift (α, β, γ, and δ) in NMR and that have a constant chemical shift (ϵ). In comparison with base oil of a constant molecular weight, a more proportion of ϵ-methylene content corresponds to less branching or a longer $CH_2$ chain without branches on the main chain, while a smaller proportion of ϵ-methylene content corresponds to more branching or a shorter $CH_2$ chain without branches on the main chain.

The iodine value of the lubricating base oil component (c) is preferably 1 or less, more preferably 0.5 or less, even more preferably 0.3 or less, particularly preferably 0.15 or less, and most preferably 0.1 or less. While the iodine value could be below 0.01, due to its corresponding effect being small and its economic efficiency, it is preferably 0.001 or greater, more preferably 0.01 or greater, even more preferably 0.03 or greater, and particularly preferably 0.05 or greater. By making the iodine value of the lubricating base oil component to be 0.5 or less, the thermal and oxidation stability can be dramatically improved.

For the production of the lubricating base oil component (c), raw oil containing normal paraffin can be used. The raw oil may be any of mineral oil and synthetic oil, or may be a mixture of multiple types thereof. The normal paraffinic component content in the raw oil, based on the total mass of the raw oil, is preferably 50% by mass or greater, more preferably 70% by mass or greater, even more preferably 80% by mass or greater, still more preferably 90% by mass or greater, particularly preferably 95% by mass or greater, and most preferably 97% by mass or greater.

Examples of the raw material containing wax include oil derived by solvent refining such as raffinate, partially solvent dewaxed oil, deasphalted oil, distillates, vacuum gas oil, coker gas oil, slack wax, foots oil, and Fischer-Tropsch wax. The slack wax and Fischer-Tropsch wax are preferable among them.

The slack wax is typically derived from hydrocarbon feedstock by solvent or propane dewaxing. While the slack wax could contain residual oil, the residual oil can be removed by deoiling. The foots oil corresponds to deoiled slack wax.

The Fischer-Tropsch wax is produced by a method referred to as Fischer-Tropsch synthesis.

The raw oil derived by solvent extraction is obtained by forwarding high boiling oil fraction from atmospheric distillation to a vacuum distillation device and by solvent extracting the distillate fraction from the device. The residue of vacuum distillation may be deasphalted. In solvent extraction, aromatic component content is dissolved in extraction phase while more paraffinic components remain in raffinate phase. Naphthene is distributed over the extraction phase and the raffinate phase. Preferable examples of the solvent used for solvent extraction may include phenol, furfural, and N-methylpyrrolidone. By controlling the solvent to oil ratio, extraction temperature, and contacting method of distillate to be extracted with solvent, the degree of separation between the extraction phase and the raffinate phase can be controlled. Further, by using a fuel oil hydrocracking device having a severe hydrocracking capability, the bottom distillate obtainable from the fuel oil hydrocracking device may be used as raw oil.

The raw oil described above can undergo the process of hydrocracking/hydroisomerization such that the product of process has a saturated component content of 95% by mass or more, a cyclic saturated component of 60% by mass or less contained in the saturated component content, a viscosity index of 120 or more, and the content of ϵ-methylene contained in total constituent carbon at a proportion of 15 to 20%, whereby the lubricating base oil (C) can be obtained. The hydrocracking or hydroisomerization process is not specifically restricted as long as the urea adduct value and viscosity index of the resultant of the process obtained satisfy the above conditions. A preferable process of hydrocracking/hydroisomerization according to the present invention includes:

a first process of hydrotreating raw oil containing normal paraffin using a hydrotreating catalyst, a second process of hydrodewaxing the product of the first process using a hydrodewaxing catalyst, and a third process of hydrorefining the product of the second process using a hydrorefining catalyst. For the product of the third process obtained, a predetermined component may be separated and removed by distillation and the like as necessary.

In the lubricating base oil component obtained by the method described above, according to the present invention, as long as the saturated component content, cyclic saturated component content contained in the saturated component, viscosity index, and proportion of ϵ-methylene contained in total constituent carbon meet the above conditions, other properties are not specifically restricted. However, it is preferable that the lubricating base oil component according to the present invention further meet the following conditions.

While the aromatic component content in the lubricating base oil component (c) is not specifically restricted, it is preferably 5% by mass or less, more preferably 2% by mass or less, even more preferably 1% by mass or less, particularly preferably 0.5% by mass or less, and most preferably 0.3% by mass or less.

While the sulfur content in the lubricating base oil component (c) is not specifically restricted, it is preferably 50 ppm by mass or less, more preferably 10 ppm by mass or less, even more preferably 5 ppm by mass or less, and particularly preferably 1 ppm by mass or less.

While the density ($\rho_{15}$) of the lubricating base oil component (c) at 15° C. depends on the viscosity grade of the lubricating base oil component, the density preferably equals to the value ρ or less, i.e., $\rho_{15} \leq \rho$, where the ρ is represented by the formula (A) shown in the description of the first embodiment. In the case where $\rho_{15} > \rho$, the viscosity-temperature characteristics, thermal and oxidation stability, and further the anti-volatility and low temperature viscosity characteristics are likely to be deteriorated, and thus the fuel savings may be degraded. In the case where the lubricating base oil component is mixed with additives, the effectiveness of the additives may be lowered. More specifically, the density ($\rho_{15}$) of the lubricating base oil component (c) at 15° C. is preferably 0.840 or less, more preferably 0.830 or less, even more preferably 0.825 or less, and particularly preferably 0.822 or less.

The evaporation loss of the lubricating base oil component (c), as Noack evaporation amount, is preferably 20% by mass or less, more preferably 16% by mass or less, and particularly preferably 10% by mass or less. It is not preferable that the Noack evaporation amount of the lubricating base oil component (c) exceed 20% by mass, which increases the evaporation loss of the lubricating oil and causes an increase in viscosity and the like.

While the lubricating base oil of the third lubricating oil composition can be constituted by the lubricating base oil component (c) alone, it may further include, besides the lubricating base oil component (c), mineral base oil, synthetic base oil, or any mixture of more than one type of the lubricating oil selected therefrom. However, when the lubricating base oil component (c) is used together with other lubricating base oil components, the proportion of the other lubricating base oil components, based on the total mass of the lubricating base oil, is preferable to be 60% by mass or less, more preferable to be 40% by mass or less, even more preferable to be 30% by mass or less, and particularly preferable to be 20% by mass or less. The fact that the proportion of the base oil components other than the lubricating base oil component (c) is 60% by mass or less can enhance the viscosity-temperature characteristics, thermal and oxidation stability, and further the anti-volatility and low temperature viscosity characteristics, thereby enhancing the fuel savings.

Examples of the other lubricating base oil components used together with the lubricating base oil component according to the present invention are not specifically restricted and include the mineral base oil and synthetic oil shown in the description of the first embodiment.

The third lubricating oil composition contains the viscosity index improver (hereinafter referred to as a "viscosity index improver (c)") having a weight average molecular weight of 50,000 or more and a ratio of the weight average molecular weight and PSSI at $1\times10^4$ or more, in an amount of 0.1 to 50% by mass. Examples of the viscosity index improver (c) are not specifically restricted as long as they meet the above conditions of the weight average molecular weight and the ratio of the weight average molecular weight and PSSI. More specifically, examples of the viscosity index improver (c) may include non-dispersant or dispersant poly(meth)acrylates, non-dispersant or dispersant ethylene-α-olefin copolymers or hydrogenated products thereof, polyisobutylenes or hydrogenated products thereof, styrene-diene hydrogenated copolymers, styrene-maleic anhydride ester copolymers, and poly (alkyl)styrenes having a weight average molecular weight of 50,000 or greater and a ratio of the weight average molecular weight and PSSI of $1\times10^4$ or greater. While the viscosity index improver (c) could be either of a non-dispersant type or dispersant type, it is more preferable to be of a dispersant type.

The weight average molecular weight ($M_w$) of the viscosity index improver (c) is necessary to be 50,000 or greater, and is more preferably 100,000 or greater, even more preferably 150,000 or greater, particularly preferably 200,000 or greater, and most preferably 300,000 or greater. Further, it is preferably 1,000,000 or less, more preferably 700,000 or less, even more preferably 600,000 or less, and particularly preferably 500,000 or less. In the case where the weight average molecular weight is below 50,000, the enhancing effect of viscosity index is small and thus not only fuel savings and low temperature viscosity characteristics may become poor, but also cost increase may arise. In the case where the weight average molecular weight exceeds 1,000,000, the shear stability, solubility to base oil, and storage stability may be deteriorated.

The ratio of the weight average molecular weight to the number average molecular weight ($M_w/M_n$) of the viscosity index improver (c) is preferably 0.5 to 5.0, more preferably 1.0 to 3.5, even more preferably 1.5 to 3, and particularly preferably 1.7 to 2.5. In the case where the ratio of the weight average molecular weight and number average molecular weight becomes 0.5 or less or becomes 5.0 or more, not only the solubility to base oil and storage stability are deteriorated, but also the viscosity-temperature characteristics are degraded, and thus the fuel saving performance may be deteriorated.

The permanent shear stability index (PSSI) of the viscosity index improver (c) is preferably 50 or less, more preferably 40 or less, even more preferably 35 or less, still more preferably 30 or less, and particularly preferably 25 or less. Furthermore, it is preferably 5 or greater, more preferably 10 or greater, even more preferably 15 or greater, and particularly preferably 20 or greater. In the case where the PSSI exceeds 50, the shear stability is deteriorated and thus the durability may become poor when deteriorated. In the case where the PSSI is below 5, the enhancing effect of viscosity index is small and thus not only fuel savings and low temperature viscosity characteristics may become poor, but also cost increase may arise.

The ratio of the weight average molecular weight and PSSI ($M_w$/PSSI) of the viscosity index improver (c) is necessary to be $1\times10^4$ or greater, and is preferably $1.5\times10^4$ or greater, more preferably $1.8\times10^4$ or greater, and even more preferably $2.0\times10^4$ or greater. In the case where the $M_w$/PSSI is below $1\times10^4$, the viscosity-temperature characteristics may be deteriorated, i.e., the fuel savings may be deteriorated.

The content of the viscosity index improver (c), based on the total mass of the composition, is necessary to be 0.1 to 50% by mass, and is more preferably 0.5% by mass or greater, even more preferably 1% by mass or greater, and particularly preferably 5% by mass or greater. Additionally, it is more preferably 40% by mass or less, even more preferably 30% by mass or less, and particularly preferably 20% by mass or less. In the case where the content of the viscosity index improver (c) becomes 0.1% by mass or less, the enhancing effect of viscosity index and the reduction effect of product viscosity become small and thus the enhancing of fuel savings may not be achieved. In the case where it becomes 50% by mass or more, the product cost is significantly increased and, as it becomes necessary to reduce the viscosity of base oil, the lubrication performance under a severe lubrication condition (high-temperature high-shear condition) is degraded and the concerns to cause problems such as wear, seizure and fatigue failure may arise.

The third lubrication oil composition may further include, besides the viscosity index improver (c) described above, ordinary common non-dispersant or dispersant poly(meth) acrylates, non-dispersant or dispersant ethylene-α-olefin copolymers or hydrogenated products thereof, polyisobutylenes or hydrogenated products thereof, styrene-diene hydrogenated copolymers, styrene-maleic anhydride ester copolymers, and poly(alkyl)styrenes.

The third lubricating oil composition may further comprise, in order to enhance the fuel saving performance, a friction modifier selected from organic molybdenum compounds and ashless friction modifiers. The specific examples and use of the organic molybdenum compounds and ashless friction modifiers are the same as those of the first embodiment, and thus their redundant descriptions are omitted here.

In the third lubricating oil composition, in order to further enhance its performance, any of generally used additives can be included in the lubricating oil according to its purpose. Such additives include the additives of, for example, a metallic detergent, ashless dispersant, antioxidant, anti-wear agent (or extreme pressure additive), corrosion inhibitor, rust inhibitor, pour point depressant, demulsifier, metal deactivator, and antifoaming agent. The specific examples and use of the additives are the same as those of the first embodiment, and thus their redundant descriptions are omitted here.

The kinematic viscosity of the third lubricating oil composition at 100° C. is necessary to be 3.0 to 12.0 $mm^2/s$, and is preferably 4.5 $mm^2/s$ or greater, more preferably 5.0 $mm^2/s$ or greater, even more preferably 6.0 $mm^2/s$ or greater, and particularly preferably 7.0 $mm^2/s$ or greater, while it is preferably 10.0 $mm^2/s$ or less, more preferably 9.0 $mm^2/s$ or less, even more preferably 8.0 $mm^2/s$ or less, and particularly preferably 7.5 $mm^2/s$ or less. In the case where the kinematic viscosity at 100° C. is below 3.0 $mm^2/s$, the lack of lubricity may result and, in the case where the viscosity exceeds 12.0 $mm^2/s$, the required low temperature viscosity and sufficient fuel saving performance may not be obtainable.

The kinematic viscosity of the third lubricating oil composition at 40° C. is preferably 4 to 50 $mm^2/s$, more preferably 10 to 40 $mm^2/s$, even more preferably 20 to 35 $mm^2/s$, and particularly preferably 27 to 32 $mm^2/s$. When the kinematic viscosity at 40° C. is below 4 $mm^2/s$, the lack of lubrication may result and, when the viscosity exceeds 50 $mm^2/s$, the required low temperature viscosity and sufficient fuel saving performance may not be obtainable.

The viscosity index of the third lubricating oil composition is preferably in a range of 140 to 300, more preferably 190 or greater, even more preferably 200 or greater, particularly preferably 210 or greater, and most preferably 220 or greater. In the case where the viscosity index of the third lubricating oil composition is below 140, the enhancing of fuel savings while maintaining HTHS viscosity may become difficult and further the reduction of low temperature viscosities such as CCS viscosity and MRV viscosity at −35° C. or lower may become difficult. In the case where the viscosity index of the third lubricating oil composition is 300 or more, the low temperature fluidity is deteriorated and further the problems by the lack of solubility of additives and compatibility with seal materials may arise.

The HTHS viscosity of the third lubricating oil composition at 100° C. is preferably 6.0 mPa·s or less, more preferably 5.5 mPa·s or less, even more preferably 5.3 mPa·s or less, particularly preferably 5.0 mPa·s or less, and most preferably 4.8 mPa·s or less. Further, it is preferably 3.0 mPa·s or greater, more preferably 3.5 mPa·s or greater, even more preferably 4.0 mPa·s or greater, particularly preferably 4.2 mPa·s or greater, and most preferably 4.3 mPa·s or greater. In the case where the HTHS viscosity at 100° C. is below 3.0 mPa·s, the lack of lubricity may arise and, in the case where the viscosity exceeds 6.0 mPa·s, the required low temperature viscosity and sufficient fuel saving performance may not be obtainable.

The HTHS viscosity of the third lubricating oil composition at 150° C. is preferably 3.5 mPa·s or less, more preferably 3.0 mPa·s or less, even more preferably 2.8 mPa·s or less, and particularly preferably 2.7 mPa·s or less. Furthermore, it is preferably 2.0 mPa·s or greater, more preferably 2.3 mPa·s or greater, even more preferably 2.4 mPa·s or greater, particularly preferably 2.5 mPa·s or greater, and most preferably 2.6 mPa·s or greater. In the case where the HTHS viscosity at 150° C. is below 2.0 mPa·s, the lack of lubricity may arise and, in the case where the viscosity exceeds 3.5 mPa·s, the required low temperature viscosity and sufficient fuel saving performance may not be obtainable.

The ratio of the HTHS viscosity at 150° C. to the HTHS viscosity at 100° C. of the third lubricating oil composition is necessary to be 0.50 or more, and is preferably 0.52 or more, more preferably 0.54 or more, even more preferably 0.55 or more, and particularly preferably 0.56 or more. Further, it is preferably 0.80 or less, more preferably 0.70 or less, even more preferably 0.65 or less, and particularly preferably 0.60 or less. In case where the ratio of the HTHS viscosity at 150° C. to the HTHS viscosity at 100° C. is below 0.50, sufficient fuel saving performance and the required low temperature viscosity may not be obtainable and, in the case where the viscosity exceeds 0.80, a substantial cost increase in base material and the lack of solubility of additives may result.

EXAMPLES

Now, the present invention will further be described more specifically based on examples and comparative examples below However, it is not intended to limit the present invention to the following examples only.

Examples 1-1 and 1-2, Comparative Examples 1-1 to 1-4

In the examples 1-1 and 1-2, and comparative examples 1-1 to 1-4, lubricating oil compositions having compositions shown in Table 2 were prepared, using the base oils shown below. The properties of base oils O-1-1 and O-1-2 are shown in Table 1.

(Base Oils)

O-1-1 (base oil 1): a mineral oil obtained by hydrocracking/hydroisomerization of n-paraffin-containing oil O-1-2 (base oil 2): a hydrogenated base oil (Additives)

A-1-1 (viscosity index improver 1-1): dispersant polymethacrylate (a copolymer obtained by polymerization of 70% by mole of total of methyl methacrylate and dimethylaminoethyl methacrylate, 20% by mole of total of methacrylate in which $R^2$ in general formula (2) is an alkyl group with 16 carbon atoms, methacrylate in which $R^2$ in general formula (2) is an alkyl group with 18 carbon atoms, and methacrylate in which $R^2$ in general formula (2) is an alkyl group with 20 carbon atoms, and 10% by mole of methacrylate in which $R^2$ in general formula (2) is a branched alkyl group with 22 carbon atoms. MW=400,000, Mw/Mn=2.2, PSSI=20, and Mw/PSSI ratio=$2\times10^4$)

A-1-2 (viscosity index improver 1-2): non-dispersant polymethacrylate (a copolymer obtained by polymerization of methyl methacrylate, methacrylate in which $R^4$ in general formula (3) is an alkyl group with 12 carbon atoms, methacrylate in which $R^4$ in general formula (3) is an alkyl group with 13 carbon atoms, methacrylate in which $R^4$ in general formula (3) is an alkyl group with 14 carbon atoms, and methacrylate in which $R^4$ in general formula (3) is an alkyl group with 15 carbon atoms. Mw=80,000, Mw/Mn=2.7, PSSI=5, and Mw/PSSI ratio=$2\times10^4$)

A-1-3 (viscosity index improver 1-3): dispersant polymethacrylate (a copolymer obtained by polymerization of methyl methacrylate, methacrylate in which $R^4$ in general formula (3) is an alkyl group with 12 carbon atoms, methacrylate in which $R^4$ in general formula (3) is an alkyl group with 13 carbon atoms, methacrylate in which $R^4$ in general formula (3) is an alkyl group with 14 carbon atoms, methacrylate in which $R^4$ in general formula (3) is an alkyl group with 15 carbon atoms, and dimethylaminoethyl methacrylate. Mw=300,000, Mw/Mn=4.0, PSSI=40, and Mw/PS SI ratio=7500)

B-1-1 (ashless friction modifier 1-1): glycerin monooleate

B-1-2 (ashless friction modifier 1-2): oleylurea

C-1-1 (other additives): additives package (including metallic detergent, ashless dispersant, antioxidant, anti-wear agent, pour point depressant, antifoaming agent, and the like)

TABLE 1

| | | | O-1-1 | O-1-2 |
|---|---|---|---|---|
| Urea adduct value | | % by mass | 1.3 | 4.6 |
| Density (15° C.) | | g/cm$^3$ | 0.820 | 0.8388 |
| Kinematic viscosity | (40° C.) | mm$^2$/s | 15.8 | 18.72 |
| | (100° C.) | mm$^2$/s | 3.854 | 4.092 |
| Viscosity index | | | 141 | 120 |
| Pour point | | ° C. | −22.5 | −22.5 |
| Aniline point | | ° C. | 118.5 | 111.6 |
| Iodine value | | | 0.06 | 0.79 |
| Sulfur content | | ppm by mass | <1 | 2 |
| Nitrogen content | | ppm by mass | <3 | <3 |
| NOACK evaporation loss | | % by mass | 7.5 | 16.1 |
| Chromatographic fractionation | % by mass | saturated component | 99.6 | 95.1 |
| | | aromatic component | 0.2 | 4.7 |
| | | resin content | 0.1 | 0.2 |
| | | recovery rate | 99.9 | 100 |
| Paraffinic component content based on saturated component | | % by mass | 87.1 | 50.6 |
| Naphthenic component content based on saturated component | | % by mass | 12.9 | 49.4 |
| Distillation characteristics | | IBP ° C. | 363.0 | 324.6 |
| | | 10% | 396.0 | 383.4 |
| | | 50% | 432.0 | 420.1 |
| | | 90% | 459.0 | 457.8 |
| | | FBP | 489.0 | 494.7 |

[Evaluation of Lubricating Oil Compositions]

For each of the lubricating oil compositions of examples 1-1 and 1-2 and comparative examples 1-1 to 1-4, the kinematic viscosities at 40° C. or 100° C., viscosity indexes, HTHS viscosities at 40° C. or 100° C., and CCS viscosities at −35° C. were measured. The respective values of their physical properties were measured by the following evaluation methods. The results obtained are shown in Table 1.

(1) Kinematic viscosity: ASTM D-445

(2) HTHS viscosity: ASTM D4683

(3) CCS viscosity: ASTM D5293

TABLE 2

| | | | Ex. 1-1 | Ex. 1-2 | Comp. Ex. 1-1 | Comp. Ex. 1-2 | Comp. Ex. 1-3 | Comp. Ex. 1-4 |
|---|---|---|---|---|---|---|---|---|
| Base oil, based on total mass of base oil | | | | | | | | |
| O-1-1 | Base oil 1 | % by mass | 100 | 70 | 0 | 0 | 0 | 100 |
| O-2-1 | Base oil 2 | % by mass | 0 | 30 | 100 | 100 | 100 | 0 |
| Additive, based on total mass of compositions | | | | | | | | |
| A-1-1 | Viscosity index improver 1-1 | % by mass | 12 | 11.4 | 10.7 | | | |
| A-1-2 | Viscosity index improver 1-2 | % by mass | | | | 5.3 | | |
| A-1-3 | Viscosity index improver 1-3 | % by mass | | | | | 4.8 | 5.6 |
| B-1-1 | Ashless friction modifier 1-1 | % by mass | 1 | 1 | 1 | 1 | 1 | 1 |
| B-2-2 | Ashless friction modifier 1-2 | % by mass | 0.3 | 0.3 | 0.3 | 0.3 | 0.3 | 0.3 |
| C-1-1 | Other additives | % by mass | 12 | 12 | 12 | 12 | 12 | 12 |
| Result and evaluation | | | | | | | | |
| Kinematic viscosity | 40° C. | $mm^2/s$ | 28.8 | 30.2 | 33.3 | 37.9 | 40.8 | 39.4 |
| | 100° C. | $mm^2/s$ | 7.5 | 7.5 | 7.7 | 7.7 | 8.8 | 8.9 |
| Viscosity index | | | 234 | 229 | 214 | 177 | 202 | 216 |
| HTHS viscosity | 100° C. | mPa · s | 4.5 | 4.6 | 4.8 | 5.3 | 5.3 | 5.0 |
| | 150° C. | mPa · s | 2.6 | 2.6 | 2.6 | 2.6 | 2.6 | 2.6 |
| CCS viscosity | −35° C. | mPa · s | 2300 | 3400 | 6700 | 8000 | — | — |

As shown in Table 2, while the lubricating oil compositions of the examples 1-1 and 1-2 and comparative examples 1-1 to 1-4 have the HTHS viscosities of similar degrees at 150° C., compared with the lubricating oil compositions of the comparative examples 1-1 to 1-4, the lubricating oil compositions of the examples 1-1 and 1-2 have lower kinematic viscosities at 40° C. and at 100° C., HTHS viscosities at 100° C. and CCS viscosities, and have good low temperature viscosities and viscosity-temperature characteristics. These results show that the lubricating oil compositions of the present invention can provide excellent fuel savings and low temperature viscosity and achieve both requirements of fuel savings and low temperature viscosity at −35° C. or lower, thereby particularly reducing the kinematic viscosities of the lubricating oil at 40° C. and 100° C., enhancing the viscosity index, and significantly improving the CCS viscosity at −35° C., while maintaining the high temperature high shear viscosity at 150° C., without using synthetic oil such as poly-α-olefin based base oil and ester based base oil, or low viscosity mineral base oil.

Examples 2-1 to 2-4, Comparative Examples 2-1 to 2-5

In examples 2-1 to 2-4 and comparative examples 2-1 to 2-5, the lubricating oil compositions having the compositions shown in Table 3 were prepared, using the base oils O-1-1 and O-1-2 shown in Table 1 above and the following additives shown below.

(Additives)

A-2-1 (viscosity index improver 2-1): polymethacrylate with PSSI=20, MW=400,000, and Mw/PSSI=$2\times10^4$ (a dispersant polymethacrylate based additive obtained by polymerization of 70% by mole of total of methyl methacrylate and dimethylaminoethyl methacrylate, 20% by mole of total of methacrylate in which $R^2$ in general formula (2) is an alkyl group with 16 carbon atoms, methacrylate in which $R^2$ in general formula (2) is an alkyl group with 18 carbon atoms, and methacrylate in which $R^2$ in general formula (2) is an alkyl group with 20 carbon atoms, and 10% by mole of methacrylate in which $R^2$ in general formula (2) is a branched alkyl group with 22 carbon atoms)

A-2-2 (viscosity index improver 2-2): polymethacrylate with PSSI=16, MW=300,000, and Mw/PSSI=$1.9\times10^4$ (a dispersant polymethacrylate based additive containing methyl methacrylate, methacrylate in which $R^2$ in general formula (2) is an alkyl group with 16 to 22 carbon atoms, and dimethylaminoethyl methacrylate, as main structural units)

A-2-3 (viscosity index improver 2-3): polymethacrylate with PSSI=5, MW=80,000, and Mw/PSSI=$1.6\times10^4$ (a non-dispersant polymethacrylate based additive containing methyl methacrylate and methacrylate in which $R^4$ in general formula (3) is an alkyl group with 12 to 15 carbon atoms as main structural units)

A-2-4 (viscosity index improver 2-4): polymethacrylate with PSSI=0.1, MW=50,000, and Mw/PSSI=$5\times10^5$ (a non-dispersant polymethacrylate based additive containing methyl methacrylate, methacrylate in which $R^4$ in general formula (3) is an alkyl group with 12 to 15 carbon atoms, and methacrylate in which $R^2$ in general formula (2) is an alkyl group with 16 carbon atoms, as main structural units)

A-2-5 (viscosity index improver 2-5): polymethacrylate with PSSI=0 and Mw=20,000 (a non-dispersant polymethacrylate based additive containing methyl methacrylate and methacrylate in which $R^2$ in general formula (2) is an alkyl group with 16 to 22 carbon atoms as main structural units)

A-2-6 (viscosity index improver 2-6): polymethacrylate with PSSI=40, MW=300,000, and Mw/PSSI=$0.75\times10^4$ (a dispersant polymethacrylate based additive containing methyl methacrylate, methacrylate in which $R^4$ in general formula (3) is a straight alkyl group with 12 carbon atoms, methacrylate in which $R^4$ in general formula (3) is a straight alkyl group with 13 carbon atoms, methacrylate in which $R^4$ in general formula (3) is a straight alkyl group with 14 carbon atoms, methacrylate in which $R^4$ in general formula (3) is a straight alkyl group with 15 carbon atoms, and dimethylaminoethyl methacrylate, as main structural units)

A-2-7 (viscosity index improver 2-7): polymethacrylate with PSSI=40, MW=350,000, and Mw/PSSI=$0.9\times10^4$ (a dispersant polymethacrylate based additive containing methyl methacrylate, methacrylate in which $R^2$ in general formula (2) is an alkyl group with 16 to 22 carbon atoms, and dimethylaminoethyl methacrylate, as main structural units)

B-2-1 (friction modifier 2-1): glycerin monooleate

B-2-2 (friction modifier 2-2): oleylurea

B-2-3 (friction modifier 2-3): molybdenum dithiocarbamate

C-2-1 (ashless dispersant 2-1): polybutenyl succinimide (bis type, Mw 10,000, a nitrogen content of 0.5% by mass)

C-2-2 (ashless dispersant 2-2): boric acid-modified polybutenyl succinimide (bis type, Mw 4,000, a nitrogen content of 1.4% by mass, a boron content of 0.5% by mass)

D-2-1 (ashless antioxidant 2-1): an aminic antioxidant

D-2-2 (ashless antioxidant 2-2): a phenolic antioxidant

E-2-1 (metallic detergent): calcium salicylate (Ca 6.3%)

F-2-1 (anti-wear agent 2-1): secondary ZDTP (Zn 7.2% by mass, P 6.2% by mass)

F-2-2 (anti-wear agent 2-2): dithiocarbamate

[Evaluation of Lubricating Oil Compositions]

For each of the lubricating oil compositions of examples 2-1 to 2-4 and comparative examples 2-1 to 2-5, the kinematic viscosities at 40° C. or 100° C., viscosity indexes, HTHS viscosities at 100° C. or 150° C., and CCS viscosities at −35° C. were measured. The respective values of their physical properties were measured by the following evaluation methods. The results obtained are shown in Table 3.

(1) Kinematic viscosity: ASTM D-445

(2) Viscosity index: JIS K 2283-1993

(3) HTHS viscosity: ASTM D4683

(4) CCS viscosity: ASTM D5293

(5) Friction torque measurement: Using a 2000 cc DOHC engine, friction torque was measured under the condition of 1500 rpm at 80° C. Reduction ratio of friction torque was calculated with 0W-20 molybdenum dithiocarbamate (MoDTC) compound oil that is a commercially available fuel saving engine oil as reference oil.

TABLE 3

| | | | Ex. 2-1 | Ex. 2-2 | Ex. 2-3 | Ex. 2-4 | Ex. 2-5 |
|---|---|---|---|---|---|---|---|
| Base oil, based on total mass of base oil | | | | | | | |
| O-1-1 | Base oil 1 | % by mass | 100 | 100 | 70 | 0 | 70 |
| O-1-2 | Base oil 2 | % by mass | 0 | 0 | 30 | 100 | 30 |
| Additive, based on total mass of compositions | | | | | | | |
| A-2-1 | Polymethacrylate 2-1 | % by mass | 12 | | 11.4 | 10.7 | 11.6 |
| A-2-2 | Polymethacrylate 2-2 | % by mass | | 11.8 | | | |
| A-2-3 | Polymethacrylate 2-3 | % by mass | | | | | |
| A-2-4 | Polymethacrylate 2-4 | % by mass | | | | | |
| A-2-5 | Polymethacrylate 2-5 | % by mass | | | | | |
| A-2-6 | Polymethacrylate 2-6 | % by mass | | | | | |
| A-2-7 | Polymethacrylate 2-7 | % by mass | | | | | |
| B-2-1 | Friction modifier 2-1 | % by mass | 1 | 1 | 1 | 1 | |
| B-2-2 | Friction modifier 2-2 | % by mass | 0.3 | 0.3 | 0.3 | 0.3 | |
| B-2-3 | Friction modifier 2-3 | % by mass | | | | | 0.5 |
| C-2-1 | Ashless dispersant 2-1 | % by mass | 4 | 4 | 4 | 4 | 4 |
| C-2-2 | Ashless dispersant 2-2 | % by mass | 2 | 2 | 2 | 2 | 2 |
| D-2-1 | Antioxidant 2-1 | % by mass | 0.5 | 0.5 | 0.5 | 0.5 | 0.5 |
| D-2-1 | Antioxidant 2-2 | % by mass | 1 | 1 | 1 | 1 | 1 |
| E-2-1 | Metallic detergent | % by mass | 3 | 3 | 3 | 3 | 3 |
| F-2-1 | Anti-wear agent 2-1 | % by mass | 1 | 1 | 1 | 1 | 1 |
| F-2-2 | Anti-wear agent 2-2 | % by mass | 0.1 | 0.1 | 0.1 | 0.1 | 0.1 |
| G-2-1 | Other additives | % by mass | 0.4 | 0.4 | 0.4 | 0.4 | 0.4 |
| Evaluation result | | | | | | | |
| Kinematic | 40° C. | $mm^2/s$ | 29 | 30 | 30 | 33 | 30 |
| viscosity | 100° C. | $mm^2/s$ | 7.5 | 7.3 | 7.5 | 7.7 | 7.4 |
| Viscosity index | | | 244 | 227 | 229 | 214 | 231 |
| HTHS | 100° C. | mPa · s | 4.5 | 4.7 | 4.6 | 4.8 | 4.6 |
| viscosity | 150° C. | mPa · s | 2.6 | 2.6 | 2.6 | 2.6 | 2.6 |
| HTHS viscosity (150° C.)/HTHS viscosity (100° C.) | | | 0.57 | 0.55 | 0.56 | 0.54 | 0.57 |
| CCS viscosity | −35° C. | mPa · s | 3200 | 3500 | 3400 | 6700 | 3400 |
| Reduction ratio of friction torque | | % | 2.5 | 2.2 | 2.3 | 1.8 | — |

TABLE 3-continued

| | | | Ex. 2-1 | Ex. 2-2 | Ex. 2-3 | Ex. 2-4 | Ex. 2-5 |
|---|---|---|---|---|---|---|---|
| | | | Comp. Ex. 2-1 | Comp. Ex. 2-2 | Comp. Ex. 2-3 | Comp. Ex. 2-4 | Comp. Ex. 2-5 |
| Base oil, based on total mass of base oil | | | | | | | |
| O-1-1 | Base oil 1 | % by mass | 0 | 0 | 0 | 0 | 0 |
| O-1-2 | Base oil 2 | % by mass | 100 | 100 | 100 | 100 | 100 |
| Additive, based on total mass of compositions | | | | | | | |
| A-2-1 | Polymethacrylate 2-1 | % by mass | | | | | |
| A-2-2 | Polymethacrylate 2-2 | % by mass | | | | | |
| A-2-3 | Polymethacrylate 2-3 | % by mass | 5.3 | | | | |
| A-2-4 | Polymethacrylate 2-4 | % by mass | | 5.3 | | | |
| A-2-5 | Polymethacrylate 2-5 | % by mass | | | 9.7 | | |
| A-2-6 | Polymethacrylate 2-6 | % by mass | | | | 4.8 | |
| A-2-7 | Polymethacrylate 2-7 | % by mass | | | | | 8.3 |
| B-2-1 | Friction modifier 2-1 | % by mass | 1 | 1 | 1 | 1 | 1 |
| B-2-2 | Friction modifier 2-2 | % by mass | 0.3 | 0.3 | 0.3 | 0.3 | 0.3 |
| B-2-3 | Friction modifier 2-3 | % by mass | | | | | |
| C-2-1 | Ashless dispersant 2-1 | % by mass | 4 | 4 | 4 | 4 | 4 |
| C-2-2 | Ashless dispersant 2-2 | % by mass | 2 | 2 | 2 | 2 | 2 |
| D-2-1 | Antioxidant 2-1 | % by mass | 0.5 | 0.5 | 0.5 | 0.5 | 0.5 |
| D-2-1 | Antioxidant 2-2 | % by mass | 1 | 1 | 1 | 1 | 1 |
| E-2-1 | Metallic detergent | % by mass | 3 | 3 | 3 | 3 | 3 |
| F-2-1 | Anti-wear agent 2-1 | % by mass | 1 | 1 | 1 | 1 | 1 |
| F-2-2 | Anti-wear agent 2-2 | % by mass | 0.1 | 0.1 | 0.1 | 0.1 | 0.1 |
| G-2-1 | Other additives | % by mass | 0.4 | 0.4 | 0.4 | 0.4 | 0.4 |
| Evaluation result | | | | | | | |
| Kinematic viscosity | 40° C. | $mm^2/s$ | 38 | 34 | 34 | 41 | 35 |
| | 100° C. | $mm^2/s$ | 7.7 | 7.1 | 6.9 | 8.8 | 8.2 |
| Viscosity index | | | 177 | 176 | 169 | 202 | 218 |
| HTHS viscosity | 100° C. | mPa · s | 5.3 | 5.4 | 5.4 | 5.3 | 5.3 |
| | 150° C. | mPa · s | 2.6 | 2.6 | 2.6 | 2.6 | 2.6 |
| HTHS viscosity (150° C.)/HTHS viscosity (100° C.) | | | 0.49 | 0.48 | 0.48 | 0.49 | 0.49 |
| CCS viscosity | −35° C. | mPa · s | 8000 | 7300 | 8500 | — | — |
| Reduction ratio of friction torque | | % | 0.5 | 0.3 | 0.4 | 0.5 | 0.3 |

As shown in Table 3, while the lubricating oil compositions of the examples 2-1 to 2-4 and comparative examples 2-1 to 2-5 have the HTHS viscosities of similar degrees at 150° C., compared with the lubricating oil compositions of the comparative examples 2-1 to 2-5, the lubricating oil compositions of the examples 2-1 to 2-4 have lower kinematic viscosities at 40° C. and at 100° C., HTHS viscosities at 100° C. and CCS viscosities and further have higher ratios of the HTHS at 150° C. to the HTHS at 100° C., and have good low temperature viscosities and viscosity-temperature characteristics. These results show that the lubricating oil compositions of the present invention provide excellent fuel savings and lubricity and significantly reduce the kinematic viscosities of the lubricating oil at 40° C. and at 100° C. and HTHS viscosities thereof at 100° C., which are effective for enhancing fuel efficiency, while maintaining the HTHS viscosity at a constant level, without using synthetic oil such as poly-α-olefin based base oil and ester based base oil, or low viscosity mineral base oil.

Examples 3-1 and 3-2, Comparative Examples 3-1 to 3-4

In examples 3-1 and 3-2 and comparative examples 3-1 to 3-4, the lubricating oil compositions having compositions shown in Table 4 were prepared using the base oils shown below.

(Base Oils)

O-3-1 (base oil 3-1): a mineral oil by hydrocracking/hydroisomerization of n-paraffin containing oil with saturated component content=99.6%, cyclic saturated component content in saturated component=12.9%, viscosity index=141, aniline point=119° C., density=0.820, kinematic viscosity at 100° C.=3.85 $mm^2/s$, and proportion of ϵ-methylene=16.1%

O-3-2 (base oil 3-2): a mineral oil by hydrocracking/hydroisomerization of n-paraffin containing oil with saturated component content=99.6%, cyclic saturated component content in saturated component=7.8%, viscosity index=142, aniline point=120° C., density=0.821, kinematic viscosity at 100° C.=3.93 $mm^2/s$, and proportion of ϵ-methylene=16.7%

O-3-3 (base oil 3-3): a mineral oil by hydrocracking/hydroisomerization of n-paraffin containing oil with saturated component content=99.6%, cyclic saturated component content in saturated component=10.3%, viscosity index=144, aniline point=120° C., density=0.820, kinematic viscosity at 100° C.=3.89 $mm^2/s$, and proportion of ϵ-methylene=21.1%

O-3-4 (base oil 3-4): a hydrogenated base oil with saturated component content=99.6%, cyclic saturated component content in saturated component=46.0%, viscosity index=123, aniline point=116° C., density=0.835, kinematic viscosity at 100° C.=4.30 $mm^2/s$, and proportion of ϵ-methylene=14.1%

O-3-5 (base oil 3-5): a hydrogenated base oil with saturated component content=94.8%, cyclic saturated component content in saturated component=46.3%, viscosity index=120, aniline point=113° C., density=0.839, kinematic viscosity at 100° C.=4.10 $mm^2/s$, and proportion of ϵ-methylene=14.8%.

(Additives)

A-3-1 (viscosity index improver 3-1): dispersable polymethacrylate (a copolymer obtained by polymerization of methyl methacrylate and methacrylate with 16 to 22 carbon atoms. Mw=400,000, Mw/Mn 2.2, PSSI=20, and Mw/PSSI ratio=$2\times10^4$)

A-3-2 (viscosity index improver 3-2); dispersant polymethacrylate (a copolymer obtained by polymerization of methyl methacrylate and methacrylate with 12 to 15 carbon atoms. Mw=300,000, Mw/Mn=4.0, PSSI=40, and Mw/PSSI ratio=$7.25\times10^3$)

B-3-1 (friction modifier 3-1): glycerin monooleate

B-3-2 (friction modifier 3-2): oleylurea

B-3-3 (friction modifier 3-3): molybdenum dithiocarbamate

C-3-1 (other additives): additives package (including metallic detergent, ashless dispersant, antioxidant, anti-wear agent, pour point depressor, antifoaming agent, and the like)

[Evaluation of Lubricating Oil Compositions]

For each of the lubricating oil compositions of examples 3-1 and 3-2 and comparative examples 3-1 to 3-4, the kinematic viscosities at 40° C. or 100° C., viscosity indexes, HTHS viscosities at 100° C. or 150° C., and MRV viscosities at −40° C. and engine friction were measured. The measurement of respective values of their physical properties and testing of engine were made by the following evaluation methods. The results obtained are shown in Table 4.

(1) Kinematic viscosity: ASTM D-445

(2) HTHS viscosity: ASTM D4683

(3) MRV viscosity: ASTM D5293

(4) Engine friction evaluation: Using a 2000 cc DOHC engine, friction torque was measured under the condition of 1500 rpm at 80° C. Reduction ratio of friction torque (%) was calculated with commercially available 0W-20 MoDTC compound oil as reference oil.

TABLE 4

| | | | Ex. 3-1 | Ex. 3-2 | Comp. Ex. 3-1 | Comp. Ex.e 3-2 | Comp. Ex. 3-3 | Comp. Ex. 3-4 |
|---|---|---|---|---|---|---|---|---|
| Base oil, based on total mass of base oil | | | | | | | | |
| O-3-1 | Base oil 3-1 | % by mass | 100 | | | | | 100 |
| O-3-2 | Base oil 3-2 | % by mass | | 100 | | | | |
| O-3-3 | Base oil 3-3 | % by mass | | | 100 | | | |
| O-3-4 | Base oil 3-4 | % by mass | | | | 100 | | |
| O-3-5 | Base oil 3-5 | % by mass | | | | | 100 | |
| Additive, based on total mass of compositions | | | | | | | | |
| A-3-1 | Viscosity index improver 3-1 | % by mass | 12 | 11.5 | 11.8 | 10.7 | 10.5 | |
| A-3-2 | Viscosity index improver 3-2 | % by mass | | | | | | |
| B-3-1 | Friction modifier 3-1 | % by mass | 0.5 | 0.5 | 0.5 | 0.5 | 0.5 | 0.5 |
| B-3-2 | Friction modifier 3-2 | % by mass | 0.3 | 0.3 | 0.3 | 0.3 | 0.3 | 0.3 |
| B-3-3 | Friction modifier 3-3 | % by mass | 0.5 | 0.5 | 0.5 | 0.5 | 0.5 | 0.5 |
| C-3-1 | Other additives | % by mass | 12 | 12 | 12 | 12 | 12 | 12 |
| Evaluation result | | | | | | | | |
| Kinematic viscosity | 40° C. | $mm^2/s$ | 30 | 30 | 30 | 33 | 32 | 38 |
| | 100° C. | $mm^2/s$ | 7.5 | 7.5 | 7.5 | 7.7 | 7.6 | 8.8 |
| Viscosity index | | | 234 | 230 | 235 | 214 | 217 | 220 |
| HTHS viscosity | 100° C. | mPa · s | 4.5 | 4.6 | 4.5 | 4.8 | 4.8 | 5.3 |
| | 150° C. | mPa · s | 2.6 | 2.6 | 2.6 | 2.6 | 2.6 | 2.6 |
| HTHS viscosity (150° C.)/HTHS viscosity (100° C.) | | | 0.58 | 0.57 | 0.58 | 0.54 | 0.54 | 0.49 |
| MRV viscosity | −40° C. | mPa · s | 5800 | 6800 | 28300 | 13400 | 23100 | 7300 |
| Reduction ratio of friction torque | | % | 2.5 | 2.3 | — | — | — | 0.6 |

As shown in Table 4, while the lubricating oil compositions of the examples 3-1 and 3-2 and comparative examples 3-1 to 3-4 have the HTHS viscosities of similar degrees at 150° C., compared with the lubricating oil compositions of the comparative examples 3-1 to 3-4, the lubricating oil compositions of the examples 3-1 and 3-2 have lower kinematic viscosities at 40° C. and at 100° C., HTHS viscosities at 100° C. and MRV viscosities and have good low temperature viscosities and viscosity-temperature characteristics. In addition, compared with a commercially available fuel saving 0W-20 MoDTC oil, significantly large friction torque reduction ratios, i.e., fuel savings were also resulted. These results show that the lubricating oil compositions of the present invention can provide excellent fuel savings and low temperature viscosity and achieve the compatibility of fuel savings and low temperature viscosity at −35° C. or lower, thereby particularly reducing the kinematic viscosities of the lubricating oil at 40° C. and 100° C., enhancing the viscosity index, and significantly improving the MRV viscosity at −40° C., while maintaining the high temperature high shear viscosity at 150° C., without using synthetic oil such as poly-α-olefin based base oil and ester based base oil, or low viscosity mineral base oil.

The invention claimed is:

1. A lubricating oil composition comprising:

a lubricating base oil including a lubricating base oil component having a urea adduct value of 4% by mass or less, a kinematic viscosity of 25 $mm^2/s$ or less at 40° C. and a viscosity index of 120 or greater, and comprising a saturated component that contains cyclic and acyclic components, wherein the saturated component content is 90% or greater based on the total weight of the lubricating base oil, and wherein the proportion of cyclic saturated components among the saturated components is 0.1 to 50%, and wherein the amount of the lubricating base oil component is 10 to 100% by mass based on a total mass of the lubricating base oil; and a poly(meth)acrylate based viscosity index improver including a structural unit represented by general formula (1):

[Chemical Formula 1]

(1)

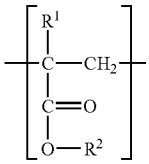

wherein $R^1$ represents hydrogen or a methyl group, and $R^2$ represents a straight or branched hydrocarbon group with 16 or more carbon atoms, and wherein the proportion of the structural unit represented by general formula (1) is 0.5 to 70% by mole, the lubricating oil composition having a kinematic viscosity of 4 to 12 $mm^2/s$ at 100 ° C. and a viscosity index of 140 to 300.

2. The lubricating oil composition according to claim 1, wherein the poly(meth)acrylate based viscosity index improver is a dispersant poly(meth)acrylate based viscosity index improver.

3. The lubricating oil composition according to claim 1, wherein the poly(meth)acrylate based viscosity index improver has a PSSI of 40 or less and a ratio of weight average molecular weight and PSSI of $1\times10^4$ or greater.

4. The lubricating oil composition according to claim 1, wherein $R^2$ in general formula (1) is a branched hydrocarbon group with 20 or more carbon atoms.

5. The lubricating oil composition according to claim 1, further comprising at least one friction modifier selected from organic molybdenum compounds and ashless friction modifiers.

6. A lubricating oil composition comprising:

a lubricating base oil having a kinematic viscosity of 1 to 10 $mm^2/s$ at 100° C. and a % $C_A$ of 5 or less, and comprising a saturated component that contains cyclic and acyclic components, wherein the saturated component content is 90% or greater based on the total weight of the lubricating base oil, and wherein the proportion of cyclic saturated components among the saturated components is 0.1 to 50%; and a viscosity index improver having a weight average molecular weight of 50,000 or greater and a ratio of the weight average molecular weight and PSSI of $0.8\times10^4$ or greater, wherein the amount of the viscosity index improver is 0.1 to 50% by mass based on a total mass of the lubricating oil composition, the lubricating oil composition having a kinematic viscosity of 3 to 9.3 $mm^2/s$ at 100° C. and a ratio of HTHS viscosity at 150° C. to HTHS viscosity at 100° C. of 0.50 or greater.

7. The lubricating oil composition according to claim 6, wherein the lubricating oil composition has an HTHS viscosity of 2.6 mPa·s or greater at 150° C. and an HTHS viscosity of 5.3 mPa·s or less at 100° C.

8. A lubricating oil composition comprising:

a lubricating base oil including as a main component, a lubricating base oil component having a saturated component content of 95% by mass or greater, a proportion of cyclic saturated component of 60% by mass or less in the saturated component, a viscosity index of 120 or greater, an urea adduct value of not greater than 4% by mass, and ϵ-methylene content in total constituent carbons at a proportion of 15 to 20%; and a viscosity index improver having a weight average molecular weight of 50,000 or greater and a ratio of the weight average molecular weight to PSSI of $1\times10^4$ or greater, in an amount of 0.1 to 50% by mass based on a total mass of the lubricating oil composition, the lubricating oil composition having a kinematic viscosity of 3.0 to 12.0 $mm^2/s$ at 100° C. and a ratio of HTHS viscosity at 150° C. to HTHS viscosity at 100° C. of 0.50 or greater.

9. The lubricating oil composition according to claim 8, wherein the lubricating oil composition has an HTHS viscosity of 2.6 mPa·s or greater at 150° C. and an HTHS viscosity of 5.3 mPa·s or less at 100° C.

10. The lubricating oil composition according to claim 8, wherein the viscosity index improver is a dispersant poly (meth)acrylate based viscosity index improver.

11. The lubricating oil composition according to claim 8, further comprising at least one friction modifier selected from organic molybdenum compounds and ashless friction modifiers.

* * * * *